US012680036B2

(12) United States Patent
Bitting et al.

(10) Patent No.: US 12,680,036 B2
(45) Date of Patent: Jul. 14, 2026

(54) RECYCLED CONTENT LIQUIFIED PYROLYSIS GAS AS FEEDSTOCK TO CRACKER FACILITY

(71) Applicant: ExxonMobil Product Solutions Company, Spring, TX (US)

(72) Inventors: Daryl Bitting, Longview, TX (US); David Eugene Slivensky, Tatum, TX (US); Xianchun Wu, Longview, TX (US)

(73) Assignee: ExxonMobil Product Solutions Company, Spring, TX (US)

( * ) Notice: Subject to any disclaimer, the term of this patent is extended or adjusted under 35 U.S.C. 154(b) by 441 days.

(21) Appl. No.: 18/558,386

(22) PCT Filed: Apr. 28, 2022

(86) PCT No.: PCT/US2022/026745

§ 371 (c)(1),
(2) Date: Nov. 1, 2023

(87) PCT Pub. No.: WO2022/250832

PCT Pub. Date: Dec. 1, 2022

(65) Prior Publication Data

US 2025/0340793 A1 Nov. 6, 2025

Related U.S. Application Data

(60) Provisional application No. 63/202,130, filed on May 28, 2021.

(51) Int. Cl.

| | |
|---|---|
| ***C10G 57/00*** | (2006.01) |
| ***C10G 1/10*** | (2006.01) |
| ***C10G 9/00*** | (2006.01) |

(52) U.S. Cl.
CPC ..... *C10G 57/00* (2013.01); *C10G 2300/1003* (2013.01); *C10G 2300/1081* (2013.01)

(58) Field of Classification Search
CPC ..... C10G 57/00; C10G 2300/1003; C10G 2300/1081; C10G 1/002; C10G 1/10; C10G 9/00; C10G 9/002; Y02P 20/143
See application file for complete search history.

(56) References Cited

U.S. PATENT DOCUMENTS 3,544,291 A 12/1970 Schlinger et al.
4,077,847 A 3/1978 Choi et al.
(Continued)

FOREIGN PATENT DOCUMENTS

CN 111778046 A 10/2020
CN 215886918 U 2/2022
(Continued)

OTHER PUBLICATIONS

Co-pending U.S. Appl. No. 17/759,460, filed Jul. 26, 2022; Bitting et al.
(Continued)

*Primary Examiner* — In Suk C Bullock
*Assistant Examiner* — Jason Y Chong
(74) *Attorney, Agent, or Firm* — C. Tumey Law Group PLLC

(57) ABSTRACT

Recycled content liquified pyrolysis gas (r-LPyG) is produced using a process and system that optimizes the production, separation, liquification, storage, loading, and/or transporting of gases generated from the pyrolysis of waste plastic. The r-LPyG can be utilized in a variety of end use applications, including as a raw material for other chemicals and chemical intermediates.

19 Claims, 12 Drawing Sheets

(56) References Cited

U.S. PATENT DOCUMENTS

| | | | |
|---|---|---|---|
| 10,927,315 | B2 | 2/2021 | Ramamurthy et al. |
| 2006/0112639 | A1 | 6/2006 | Nick et al. |
| 2007/0179326 | A1 | 8/2007 | Baker |
| 2007/0227874 | A1 | 10/2007 | Wolf-Eberhard et al. |
| 2009/0056225 | A1 | 3/2009 | Schinkski |
| 2009/0182176 | A1 | 7/2009 | Griffin |
| 2011/0218254 | A1 | 9/2011 | Chakravarti et al. |
| 2015/0080624 | A1 | 3/2015 | Gephart et al. |
| 2016/0024390 | A1 | 1/2016 | Ullom |
| 2018/0086994 | A1 | 3/2018 | Kresnyak et al. |
| 2020/0032150 | A1 | 1/2020 | Kresnyak et al. |
| 2021/0009907 | A1 | 1/2021 | Frecon et al. |

FOREIGN PATENT DOCUMENTS

| | | | | |
|---|---|---|---|---|
| EP | 713906 | A1 | 5/1996 | |
| EP | 3725403 | A1 | 4/2019 | |
| JP | H07 331251 | A | 12/1995 | |
| JP | H09 104874 | A | 4/1997 | |
| JP | 2000176403 | A | 6/2000 | |
| KR | 102206036 | B1 | 1/2021 | |
| WO | WO 95/09902 | A1 | 4/1995 | |
| WO | WO 2004/072207 | A1 | 8/2004 | |
| WO | WO 2017/050580 | A1 | 3/2017 | |
| WO | WO 2018/055555 | A1 | 3/2018 | |
| WO | WO 2020/252228 | A1 | 12/2020 | |
| WO | WO-2020242912 | A1 * | 12/2020 | ..... C10G 3/40 |
| WO | WO 2021/009312 | A1 | 1/2021 | |
| WO | WO 2021/092291 | A1 | 5/2021 | |
| WO | WO 2021/092293 | A1 | 5/2021 | |
| WO | WO 2021/092321 | A1 | 5/2021 | |

OTHER PUBLICATIONS

Co-pending U.S. Appl. No. 17/759,464, filed Jul. 26, 2022; Trapp et al.
Co-pending U.S. Appl. No. 18/567,802, filed Dec. 7, 2023; Bitting et al.
Co-pending U.S. Appl. No. 18/847,299, filed Sep. 16, 2024; Slivensky et al.
Co-pending U.S. Appl. No. 18/558,386, filed Nov. 1, 2023; Bitting et al.
Co-pending U.S. Appl. No. 18/691,107, filed Mar. 12, 2024; Slivensky et al.
Co-pending U.S. Appl. No. 18/691,088, filed Mar. 12, 2024; Bitting et al.
Co-pending U.S. Appl. No. 18/691,096, filed Mar. 12, 2024; Bitting et al.
Notification of Transmittal of the International Search Report and the Written Opinion of the International Searching Authority with Date of Mailing May 28, 2021 for International Application No. PCT/US2021/017328.
Notification of Transmittal of the International Search Report and the Written Opinion of the International Searching Authority with Date of Mailing May 28, 2021 for International Application No. PCT/US2021/017349.
Notification of Transmittal of the International Search Report and the Written Opinion of the International Searching Authority with Date of Mailing Oct. 17, 2022 for International Application No. PCT/US2022/032602.
Notification of Transmittal of the International Search Report and the Written Opinion of the International Searching Authority with Date of Mailing Jun. 28, 2023 for International Application No. PCT/US2023/064401.
Notification of Transmittal of the International Search Report and the Written Opinion of the International Searching Authority with Date of Mailing Aug. 12, 2022 for International Application No. PCT/US2022/026745.
Notification of Transmittal of the International Search Report and the Written Opinion of the International Searching Authority with Date of Mailing Dec. 5, 2022 for International Application No. PCT/US2022/043742.
Notification of Transmittal of the International Search Report and the Written Opinion of the International Searching Authority with Date of Mailing Jan. 26, 2023 for International Application No. PCT/US2022/043760.
Notification of Transmittal of the International Search Report and the Written Opinion of the International Searching Authority with Date of Mailing Dec. 21, 2022 for International Application No. PCT/US2022/043741.
Hossam, Gabbar A. et al: "An Energy evaluation for thermal conversion of thermoplastic waste to refined oil products using pyrolysis reaction process system." Jan. 1, 2016, pp. 65-79.
Saebea, Dang et al.; "Gasification of plastic waste for synthesis gas production"; Energy Reports Jun. 2020 pp. 202-207.

* cited by examiner

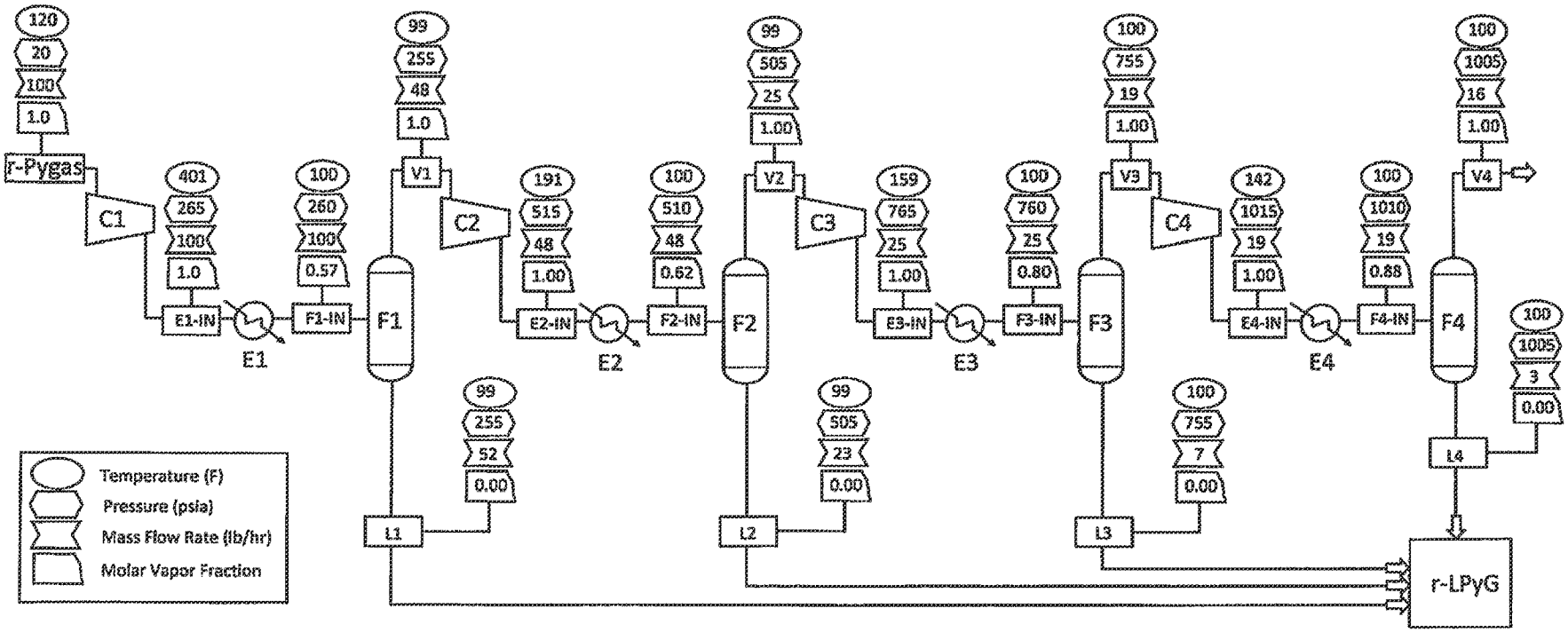
Figure 11: Simulation of 4-Stage r-Pygas Liquification

RECYCLED CONTENT LIQUIFIED PYROLYSIS GAS AS FEEDSTOCK TO CRACKER FACILITY

CROSS-REFERENCE TO RELATED APPLICATION(S)

This application is a national stage filing under 35 USC § 371 of International Application Number PCT/US2022/026745, filed on, Apr. 28, 2022 which claims the benefit of the filing date to U.S. Provisional Application No. 63/202,130, filed on May 28, 2021, the entire disclosures of which are incorporated by reference herein.

BACKGROUND

Waste plastic pyrolysis plays a part in a variety of chemical recycling technologies. Typically, waste plastic pyrolysis facilities focus on producing recycled content pyrolysis oil (r-pyoil) that can be readily transported to an onsite or offsite facility for further use in making recycled content products.

In addition to r-pyoil, waste plastic pyrolysis produces heavy components (e.g., waxes, tar, and char) and recycled content pyrolysis gas (r-pygas). Although r-pygas produced by the waste plastic pyrolysis typically has 100 percent recycled content, it is common practice for the r-pygas to be burned as fuel to provide heat for the pyrolysis reaction. Although burning r-pygas as fuel for pyrolysis may be economically efficient, such practice runs counter to one of the main goals of chemical recycling, which is to transform as much of the waste plastic as possible in new products. Thus, a better use for r-pygas is needed.

SUMMARY

In one aspect, the present technology concerns a process for producing one or more recycled content product streams from a cracker facility, the process comprising: (a) pyrolyzing waste plastic to thereby produce a recycled content pyrolysis gas (r-pygas); (b) liquifying at least a portion of the r-pygas to thereby provide a recycled content liquified pyrolysis gas (r-LPyG); (c) cracking a hydrocarbon feed stream in a cracking furnace of a cracker facility to thereby produce an cracked furnace effluent stream; (d) combining at least a portion of the r-LPyG with the cracked effluent stream to thereby produce a combined recycled content stream; and (e) separating the combined recycled content stream in a separation zone of the cracker facility to provide at least one recycled content hydrocarbon product stream.

In one aspect, the present technology concerns a process for producing one or more recycled content product streams from a cracker facility, the process comprising: (a) cracking a hydrocarbon feed stream in a cracking furnace of a cracker facility to thereby produce a cracked effluent stream; (b) quenching at least a portion of the cracked effluent stream in a quench zone to thereby produce a quenched effluent stream; (c) compressing at least a portion of the quenched effluent stream in a compression zone to thereby produce a compressed effluent stream; (d) separating the compressed effluent stream in a separation zone to thereby produce one or more hydrocarbon products; and (e) introducing a stream of recycled content liquified pyrolysis gas (r-LPyG) formed from the pyrolysis of waste plastic into one or more of the following locations (i) through (iv): (i) downstream of the quench zone and upstream of the compression zone; (ii) in the compression zone; (iii) downstream of the compression zone and upstream of the separation zone; and (iv) in the separation zone, wherein at least one of said hydrocarbon products comprises at least a portion of said r-LPyG and is a recycled content hydrocarbon product.

BRIEF DESCRIPTION OF THE DRAWINGS

FIG. 11 is a computer simulation flow diagram of a process for producing r-LPyG.

DETAILED DESCRIPTION

We have discovered new methods and systems for providing a readily storable and transportable feed material produced from a recycled content stream previously burned as fuel. More specifically, we have discovered that pyrolysis gas produced from the pyrolysis of waste plastic can be liquified for use as a storable and/or transportable feed to a chemical manufacturing facility.

Figure 1:
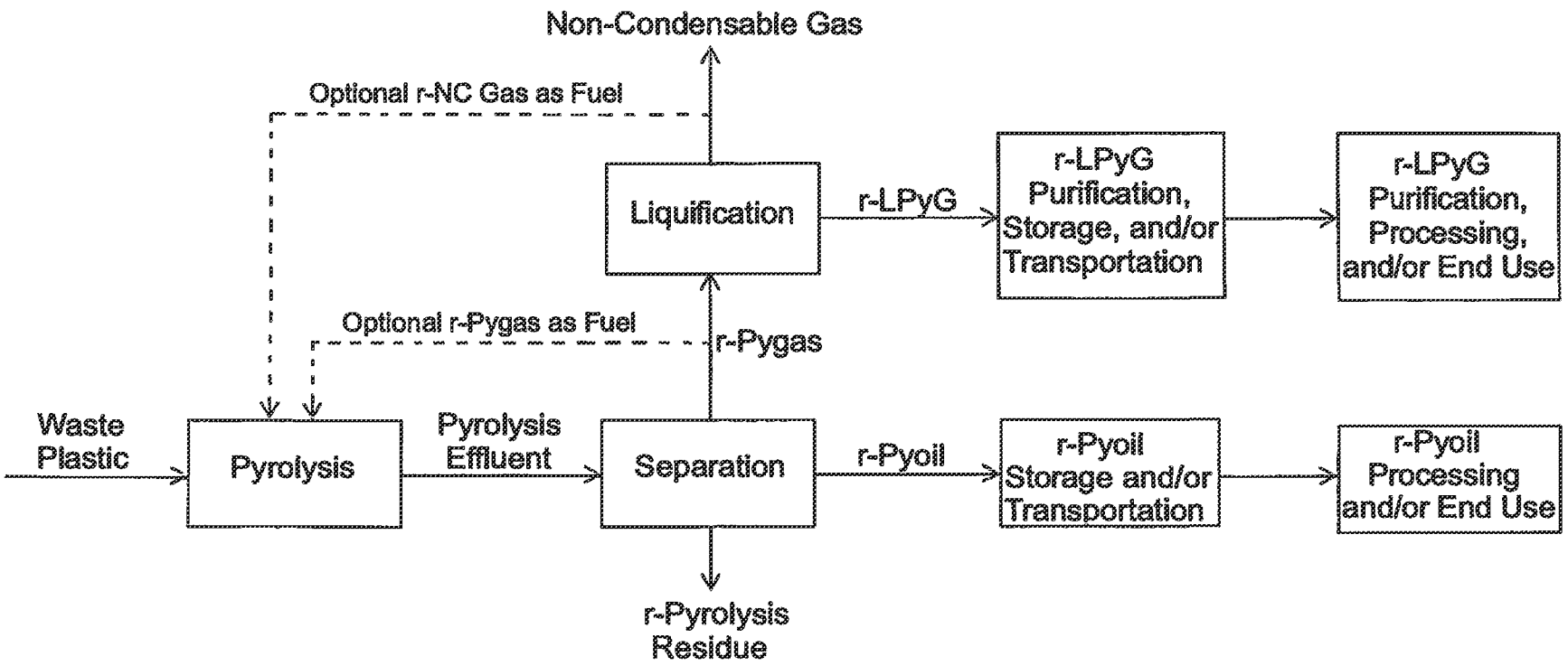
FIG. 1 is a block flow diagram illustrating the main steps of a process and facility for making and using recycled content liquified pyrolysis gas (r-LPyG)

FIG. 1 illustrates one embodiment of a process and system for use in chemical recycling of waste plastic. The process depicted in FIG. 1 starts with a pyrolysis step where waste plastic is pyrolyzed to produce a pyrolysis effluent. The pyrolysis effluent is then subjected to separation to provide at least a recycled content pyrolysis oil (r-pyoil), a recycled content pyrolysis gas (r-pygas), and a recycled content pyrolysis residue (r-pyrolysis residue).

As used herein, the term "r-pygas" refers to a composition obtained from waste plastic pyrolysis that is gaseous at 25° C. at 1 atm. As used herein, the terms "r-pyoil" refers to a composition obtained from waste plastic pyrolysis that is liquid at 25° C. and 1 atm. As used herein, the term "r-pyrolysis residue" refers to a composition obtained from waste plastic pyrolysis that is not r-pygas or r-pyoil and that comprises predominantly pyrolysis char and pyrolysis heavy waxes. As used herein, the term "pyrolysis char" refers to a carbon-containing composition obtained from pyrolysis that is solid at 200° C. and 1 atm. As used herein, the term "pyrolysis heavy waxes" refers to C20+ hydrocarbons obtained from pyrolysis that are not pyrolysis char, pyrolysis gas, or pyrolysis oil.

In an embodiment or in combination with any embodiment mentioned herein, the r-pyoil can be the predominate product produced by the waste plastic pyrolysis step, with the r-pygas being a minor/coproduct of the pyrolysis step. For example, the amount by weight of r-pygas produced from pyrolyzing the waste plastic can be less than 75, or less than 50, or less than 40, or less than 30, or less than 20 weight percent of the amount of r-pyoil produced from pyrolyzing the waste plastic. Additionally, or alternatively, the pyrolyzing can convert 30 to 95, or 40 to 90, or 50 to 80, or 55 to 75 weight percent of the waste plastic feedstock into the r-pyoil and/or the pyrolyzing can convert 0.5 to 50, or 1 to 40, or 2 to 30, or 4 to 25 weight percent of the waste plastic feedstock into the r-pygas.

As shown in FIG. 1, since the r-pyoil produced by the process in FIG. 1 is a liquid at standard temperature and pressure, the r-pyoil can be readily stored and/or transported in a liquid state. As depicted in FIG. 1, after storage and/or transportation, the r-pyoil can be further processed and/or used for its intended end use, which can include the manufacture of recycled content chemical products. Because r-pyoil is a liquid that is readily storable and transportable (e.g., via railcar tanks, tank trucks, tanker ships, and/or pipelines), the end use facility for the r-pyoil can be located remotely from the facility where the r-pyoil is produced. For example, the processing and/or end use of the r-pyoil can be carried out at a facility or site that is at least 1, or at least 10, or at least 50, or at least 500, or at least 1000 miles from the location of the pyrolysis facility.

The r-pygas produced by the process in FIG. 1 is a gas at standard temperature and pressure. As discussed above, in the past, the r-pygas produced by commercial-scale waste plastic pyrolysis facilities was used as fuel to provide heat for the pyrolysis reaction. This burning of 100% recycled content r-pygas runs counter to a basic principle of chemical recycling, which is to promote a circular economy for plastics and chemicals where as much recycled content as possible from waste plastic is reused to make new products. In addition, burning 100% recycled content r-pygas negatively affects the life cycle analysis (LCA) of the waste plastic pyrolysis facility.

As shown in FIG. 1, in accordance with embodiments of the present technology, little or none of the r-pygas from the separation step is used as fuel for the pyrolysis step. Rather, all or most of the r-pygas exiting the separation step is fed to a liquification process/facility, where the r-pygas is liquified to produce a recycled content liquified pyrolysis gas (r-LPyG). For example, at least 50, or at least 75, or at least 90, or at least 95, or 100 weight percent of the r-pygas recovered from the separation step is provided to the liquification step, while less than 50, or less than 25, or less than 10, or less than 5, or 0 weight percent of the r-pygas recovered from the separation step is used as fuel for the pyrolysis reaction. Existing pyrolysis facilities seeking to incorporate the present technology may reduce and/or eliminate the use of r-pygas as fuel for the pyrolysis reaction and start and/or increase the flow of r-pygas to the liquification process.

As discussed in further detail below with reference to FIGS. 2 and 6-9, the liquification step can included compression, cooling, absorption, expansion, and/or separation steps sufficient to liquify at least 50, or at least 75, or at least 90, or at least 95, or at least 99 weight percent of the C3 to C5 compounds present in the r-pygas produced from the pyrolysis step and introduced into the liquification step. The liquification step can also be sufficient to liquify at least 20, or at least 30, or at least 40, or at least 50, or at least 60, or at least 70, or at least 80, or at least 90, or at least 95 weight percent of the total r-pygas produced from the pyrolysis step and introduced into the liquifying step.

FIG. 1 shows that a non-condensable gas can be produced from the liquification process. The non-condensable gas can contain components that do not liquify during the compression, cooling, absorption, expansion, and/or separation steps of the liquification process. For example, the non-condensable gas can comprise ethane and lighter components in an amount of at least 25, or at least 40, or at least 50, or at least 60, or at least 70 weight percent. Examples of ethane and lighter components that can be present in the non-condensable gas include methane, ethane, hydrogen (H2), carbon monoxide (CO), and carbon dioxide (CO2).

In an embodiment or in combination with any embodiment mentioned herein, at least 20, or at least 30, or at least 40, or at least 50, or at least 75, or at least 90, or at least 95, or at least 99 weight percent of the ethane and lighter compounds present in the r-pygas produced from the pyrolysis step and introduced into the liquification process are not liquified in the liquification process and exit the liquification process with the non-condensable gas. The pyrolysis facility can produce the r-LPyG in an amount by weight that is at least 1.5, or at least 2, or at least 5, or at least 10 times greater than the amount of the non-condensable gas produced.

As shown in FIG. 1, after liquification, the r-LPyG can be purified to remove one or more components in order to provide a premium (or purified) r-LPyG. The purification step/stage can remove light (e.g., C2 and lighter) hydrocarbon components, heavy (e.g., C6 and heavier) hydrocarbon components, and various impurities such as sulfur-containing compounds, halogen-containing compounds, nitrogen-containing compounds, oxygenates, etc. Several different processing steps, such as distillation, absorption, stripping, and combinations of these, can be used to process the r-LPyG into premium r-LPyG, as discussed in further detail with regard to FIGS. 5*a* and 5*b*. The purification step/stage can come during the storage and/or transportation of the r-LPyG and/or during or prior to its end use. Various processing schemes according to embodiments of the present technology are discussed in detail with regard to FIGS. 3*a-c* and 4*a-g*.

Referring again to FIG. 1, after liquification, the r-LPyG (or premium r-LPyG) can be readily stored and/or transported in a liquified state. Depending on when the purification step takes place, the liquified pyrolysis gas stored and/or transported can be crude (non-purified) or premium (purified) r-LPyG. It should be understood that, unless otherwise noted, the r-LPyG described herein can refer to the crude and/or purified form.

As shown in FIG. 1, following storage and/or transportation, the r-LPyG can be further processed and/or used for its intended end use. Because the r-LPyG is readily storable and transportable (e.g., via railcar tanks, tank trucks, tanker ships, and/or pipelines), the end use facility for the r-LPyG can be located remotely from the pyrolysis facility where the r-pyoil, r-pygas, and/or r-LPyG are produced. For example, the processing and/or end use of the r-LPyG can be carried out at a facility or site that is at least 1, or at least 10, or at least 50, or at least 500, or at least 1000 miles from the location of the pyrolysis facility.

In an embodiment or in combination with any embodiment mentioned herein, there is provided a waste plastic pyrolysis facility that (a) produces a pyrolysis effluent comprising r-pygas and a recycled content pyrolysis oil (r-pyoil), liquefies the r-pygas to produce r-LPyG, loads the r-LPyG to transportable container, and ships the r-LPyG in the transportable container from the pyrolysis facility, wherein the r-LPyG is transported in a liquified state to a destination for at least 1, at least 10, at least 50, at least 100, at least 500, or at least 1000 miles. The container received at the destination may be the same container in which the r-LPyG was shipped from the pyrolysis facility or may be a different container.

In an embodiment or in combination with any embodiment mentioned herein, the r-LPyG storage and/or transportation step depicted in FIG. 1 can involve maintaining the r-LPyG in a liquified state for a continuous period of at least 1, or at least 2, or at least 4, or at least 8, or at least 12, or at least 24, or at least 36 hours. The r-LPyG can be maintained in a liquified state by keeping it cooled and/or pressurized so that the material is maintained below the material's bubble point. For example, the r-LPyG can be maintained at a temperature of less than 40, less than 30, less than 20, or less than 15, or less than 10, or less than 5, or less than 0° C. and/or a pressure of at least 1, or at least 1.25, or at least 1.5, or at least 2, or at least 3, or at least 4 barg, or at least 5 barg, or at least 8 barg, or at least 10 barg, or at least 12 barg, or at least 15 barg, or at least 20 barg. Again, depending on when the purification step is performed in the overall process, the above can also apply to the premium (or purified) r-LPyG.

In any of the embodiments mentioning maintaining the r-LPyG (or at least a portion of the r-LyG) a liquified state (including the premium or purified r-LPyG), at least 80 wt. % of the r-LPyG is maintained as a liquid, or at least 85 wt. %, or at least 90 wt. %, or at least 92 wt. %, or at least 95 wt. %, or at least 97 wt. %, or at least 99 wt. %, or at least 99.5 wt. %, or at least 100 wt. % is maintained as a liquid. In any of these cases, the amounts can be measured starting when the r-LPyG is filled into tankage at the pyrolysis facility, or measured when transportation commences and in each case, terminating when the r-LPyG reaches its end point destination determined as when the r-LPyG is withdrawn from the tankage as a feedstock to a chemical process or end use site/facility.

In an embodiment or in combination with any embodiment mentioned herein, the apparatus in which the r-LPyG is stored and/or transported can be insulated, cooled, and/or pressurized. For example, the r-LPyG storage/transportation apparatus can be an insulated, cooled, and/or pressurized tank, conduit, and/or pipeline. The tank can be a stationary tank or a tank located on a rail car, truck, trailer, or ship. In one embodiment, after liquification, the r-LPyG is immediately loaded into a railcar tank that maintains the r-LPyG in a liquified state while it is transported via railway to the r-LPyG processing and/or end use site/facility. In another embodiment, the r-LPyG is immediately loaded into a relatively large stationary storage tank located at the pyrolysis facility, where the storage tank maintains the r-LPyG in a liquified state until one or more transportable tanks (e.g., on railcars, trucks, trailers, or ships) are ready to be loaded from the stationary storage tank. In yet another embodiment, the r-LPyG is immediately loaded into a stationary tank that maintains the r-LPyG in a liquified state until it is introduced into a pipeline or conduit for transport to the r-LPyG processing and/or end use site/facility.

As discussed in more detail below with reference to FIG. 10, in an embodiment or in combination with any embodiment mentioned herein, the processing and/or end use facilities receiving the r-LPyG and/or the r-pyoil can include a cracking facility used to produce chemicals such as olefins, which can then be used to produce a wide variety of chemical products. Thus, use of r-LPyG and/or the r-pyoil in a cracking facility can provide recycled content to a wide variety of chemical products.

In an embodiment or in combination with any embodiment mentioned herein, the r-LPyG purification step depicted in FIG. 1 can involve removing or separating out one or more components from the r-LPyG via absorption, stripping, and/or fractionation/distillation. Examples of such components can include, but are not limited to, C2 and lighter hydrocarbons, C6 and heavier hydrocarbons, water (moisture), and impurities such as sulfur, chlorides, organic oxygenates, nitrogen, arsenic, mercury, and silicon. The purified r-LPyG can remove at least 90, at least 92, at least 95, at least 97, or at least 99 weight percent of C2 and lighter components, C6 and heavier components, or one or more of water, sulfur, chlorides, organic oxygenates, nitrogen, arsenic, mercury, and/or silicon in the r-LPyG stream. As a result, the purified (premium) r-LPyG stream can include less than 5, less than 3, less than 2, or less than 1 weight percent of one or more of one or more, of all of these components.

As shown in FIG. 1, a purification step/stage can be carried out prior to or with storage and/or transportation of the r-LPyG and/or prior to or with the end use step. Additional details of specific processing configurations will be discussed in further detail with reference to FIGS. 3*a-c* and 4*a-g*.

In an embodiment or in combination with any embodiment mentioned herein, the r-LPyG processing and/or end use site/facility and the pyrolysis facility (including pyrolysis, separation, and/or liquification) can be co-located. When the facilities are co-located, the r-LPyG may not need to be maintained in a liquified state for as long or transported as far as when the facilities are located remotely from one another. However, even when the facilities are co-located, liquification of the r-pygas may be necessary to ensure, for example, that a consistent supply of r-LPyG is provided to the processing and/or end use facility. Such a consistent supply can be provided using an onsite storage tank(s) for maintaining relatively large volumes of the r-LPyG in a liquified state. These onsite storage tanks can ensure a consistent supply for r-LPyG, even if the rate of r-pygas produced by the pyrolysis facility fluctuates or has intermittent stoppages.

In an embodiment or in combination with any embodiment mentioned herein, the pyrolysis facility/process is a commercial scale facility/process receiving the waste plastic feedstock at an average annual feed rate of at least 100, or at least 500, or at least 1,000, or at least 2,000 pounds per hour, averaged over one year. Further, the pyrolysis facility can produce the r-oil and r-pygas in combination at an average annual rate of at least 100, or at least 1,000, or at least 5,000, at least 10,000, at least 50,000, or at least 75,0000 pounds per hour, averaged over one year.

In an embodiment or in combination with any embodiment mentioned herein, the r-LPyG processing and/or end use site/facility can be located remotely from the r-pyoil processing and/or end use site facility. In that case, the producer of the r-pyoil and the r-LPyG transports the r-pyoil and/or r-LPyG to different locations and/or different entities by different transportation routes. Alternatively, the r-LPyG processing and/or end use site/facility can be co-located and/or co-owned with the r-pyoil processing and/or end use site/facility. In that case, the producer of the r-pyoil and the r-LPyG can transport the r-pyoil and/or r-LPyG to the same site/facility, possibly even using the same transportation mode. For example, both r-pyoil and r-LPyG could be transported using a single train, with certain railcars carrying tanks of r-pyoil and other railcars carrying tanks of r-LPyG.

In an embodiment or in combination with any embodiment mentioned herein, the purification site/facility can be co-located or remotely located from the pyrolysis and liquification facility and/or the end use facility. In some cases, the purification facility can be remote from the pyrolysis and liquification facility, remote from the end use facility, or remote from both locations. When located remotely from one or both facilities, the purification can be carried out at a purification site/facility that is at least 1, or at least 10, or at least 50, or at least 500, or at least 1000 miles from the location of the pyrolysis and liquification site/facility and/or from the end use site/facility. Storage and/or transport of the r-LPyG and/or premium r-LPyG under the conditions previously described may be used to move the feedstock from one location to the other.

Figure 3A:
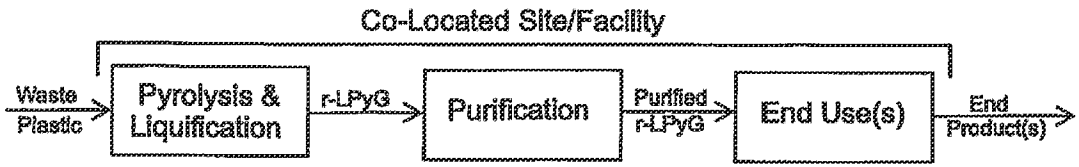
FIG. 3*a* is a block flow diagram illustrating the main steps of a process and facility for making and using recycled content premium (purified) liquified pyrolysis gas (r-LPyG), particularly showing a first embodiment of a co-located site/facility.
Figure 3B:
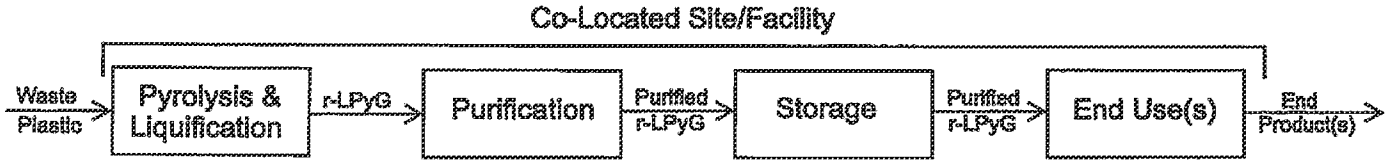
FIG. 3*b* is a block flow diagram illustrating the main steps of a process and facility for making and using recycled content premium (purified) liquified pyrolysis gas (r-LPyG), particularly showing a second embodiment of a co-located site/facility.
Figure 3C:
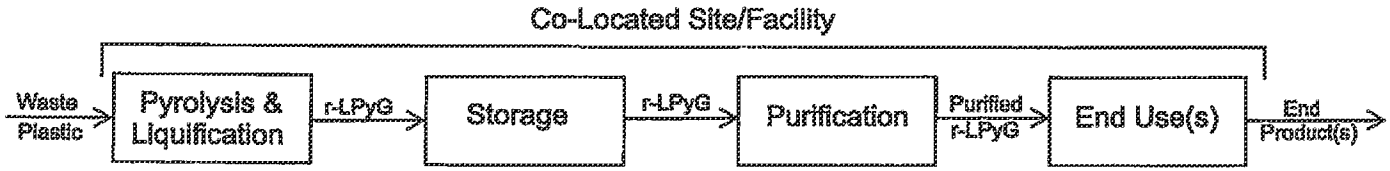
FIG. 3*c* is a block flow diagram illustrating the main steps of a process and facility for making and using recycled content premium (purified) liquified pyrolysis gas (r-LPyG), particularly showing a third embodiment of a co-located site/facility.

Turning now to FIGS. 3*a-c*, several embodiments of co-located purification and liquification, purification, and end use facilities are shown. As shown in FIG. 3*a*, in a co-located facility, the r-LPyG resulting from the pyrolysis and liquification of waste plastic can be sent to a purification zone and one or more components can be removed to form a purified r-LPyG product. This premium r-LPyG stream can then be sent to an end use facility and used form one or more end use products. One example of an end use facility is a cracker facility as described in further detail below with respect to FIG. 10.

In some embodiments shown in FIGS. 3*b* and 3*c*, the co-located site/facility can include storage before (FIG. 3*c*) or after (FIG. 3*b*) the purification facility, or it could also include storage both before and after purification (not shown). Any suitable method of storing the r-LPyG (FIG. 3*c*) or purified r-LPyG (FIG. 3*b*) can be used, including those discussed herein.

Figure 4A:
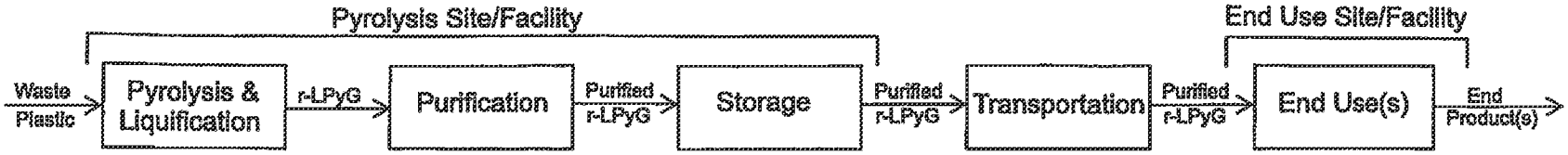
FIG. 4*a* is a block flow diagram illustrating the main steps of a process and facility for making and using recycled content premium (purified) liquified pyrolysis gas (r-LPyG), particularly showing a first embodiment with separate pyrolysis and liquification and end use sites/facilities.
Figure 4B:
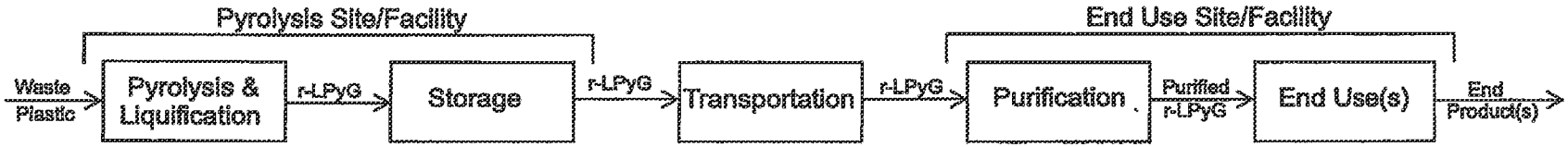
FIG. 4*b* is a block flow diagram illustrating the main steps of a process and facility for making and using recycled content premium (purified) liquified pyrolysis gas (r-LPyG), particularly showing a second embodiment with separate pyrolysis and liquification and end use sites/facilities.
Figure 4C:
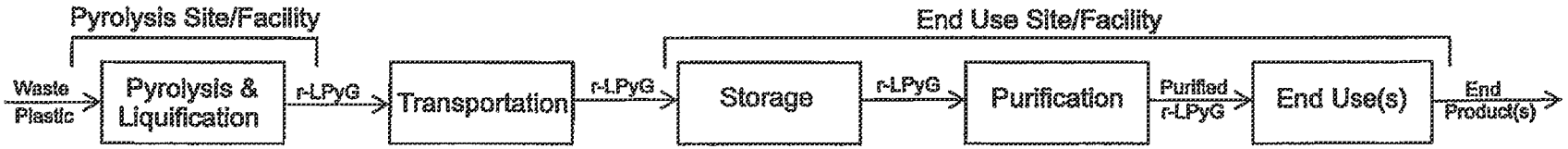
FIG. 4*c* is a block flow diagram illustrating the main steps of a process and facility for making and using recycled content premium (purified) liquified pyrolysis gas (r-LPyG), particularly showing a third embodiment with separate pyrolysis and liquification and end use sites/facilities.
Figure 4D:
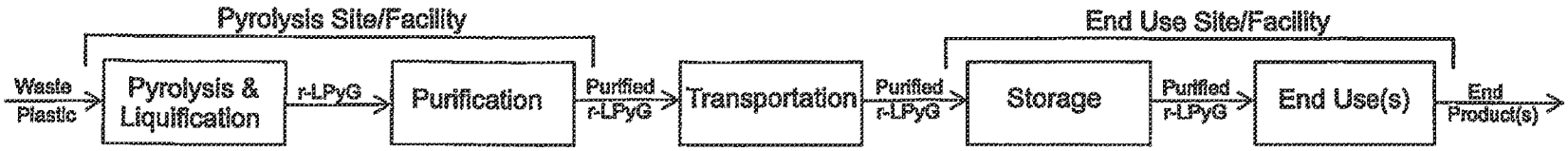
FIG. 4*d* is a block flow diagram illustrating the main steps of a process and facility for making and using recycled content premium (purified) liquified pyrolysis gas (r-LPyG), particularly showing a fourth embodiment with separate pyrolysis and liquification and end use sites/facilities.
Figure 4E:
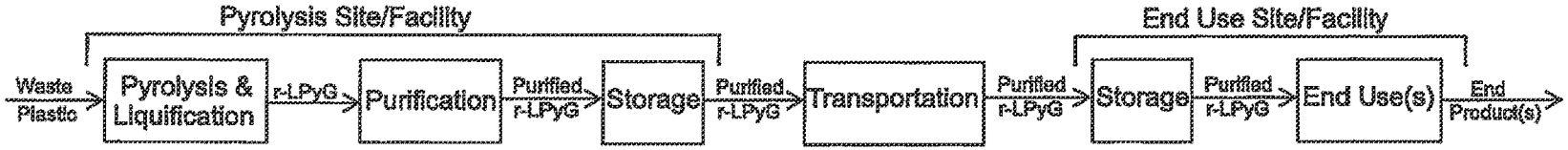
FIG. 4*e* is a block flow diagram illustrating the main steps of a process and facility for making and using recycled content premium (purified) liquified pyrolysis gas (r-LPyG), particularly showing a fifth embodiment with separate pyrolysis and liquification and end use sites/facilities.
Figure 4F:
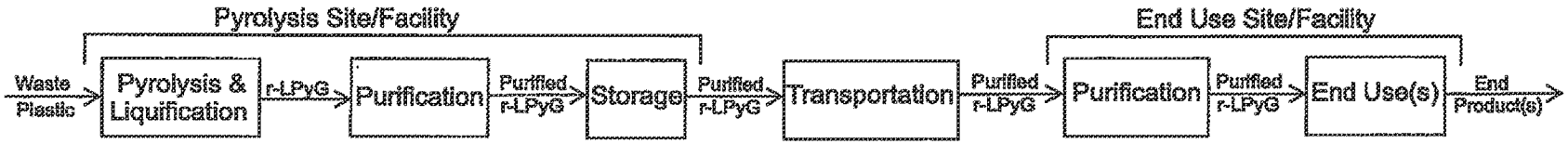
FIG. 4*f* is a block flow diagram illustrating the main steps of a process and facility for making and using recycled content premium (purified) liquified pyrolysis gas (r-LPyG), particularly showing a sixth embodiment with separate pyrolysis and liquification and end use sites/facilities.
Figure 4G:
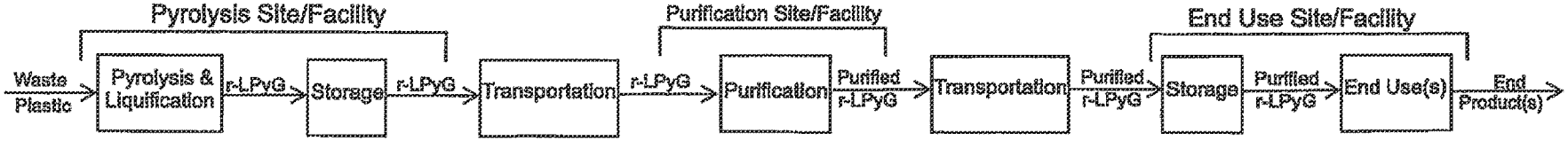
FIG. 4*g* is a block flow diagram illustrating the main steps of a process and facility for making and using recycled content premium (purified) liquified pyrolysis gas (r-LPyG), particularly showing a seventh embodiment with separate pyrolysis and liquification and end use sites/facilities.

Turning now to FIGS. 4*a-g*, several embodiments of remotely located pyrolysis and liquification, purification, and end use sites/facilities are shown. In some cases, the pyrolysis site/facility can include storage (FIGS. 4*a*, 4*b*, and 4*e-g*), while, in some cases, it may not (FIGS. 4*c* and 4*d*). Similarly, in some cases, the end use site/facility may include storage (FIGS. 4*d*, 4*e*, and 4*g*), while in some cases it may not (FIGS. 4*a*-4*c* and 4*f*). When the r-LPyG is purified, the purification step/stage can be carried out at the pyrolysis facility (FIGS. 4*a*, 4*d*, and 4*e*), at the end use facility (FIGS. 4*b* and 4*c*), or at both the pyrolysis facility and the end use facility (FIG. 4*f*). In some cases, the purification facility may itself be remote from both the pyrolysis and end use facilities as a stand-alone facility (FIG. 4*g*).

More specifically, as shown in FIG. 4*a*, in some embodiments, r-LPyG can be purified and the purified r-LPyG stored before being transported to an end use facility, or the crude r-LPyG can be stored at the pyrolysis facility before being transported to and purified at the end use facility as shown in FIG. 4*b*. As shown in FIG. 4*c, r*-LPyG from the pyrolysis facility can be immediately transported to the end use facility, wherein it can be stored and then purified, or purified r-LPyG can be transported for storage prior to end use as shown in FIG. 4*d*. FIG. 4*e* depicts a similar embodiment wherein purified r-LPyG is stored before and after transportation at the pyrolysis and end use facilities, while FIG. 4*f* depicts an embodiment wherein the r-LPyG is purified in both the pyrolysis and end use facility. As shown in FIG. 4*g, r*-LPyG stored at the pyrolysis facility is transported to and purified in a purification site/facility and the purified r-LPyG can be transported, stored, and utilized in the end use facility. The conditions for the storage and transportation of the r-LPyG and purified r-LPyG in each of these embodiments shown in FIGS. 4*a-g* (and variations of these) fall within the ranges discussed herein.

Figure 2:
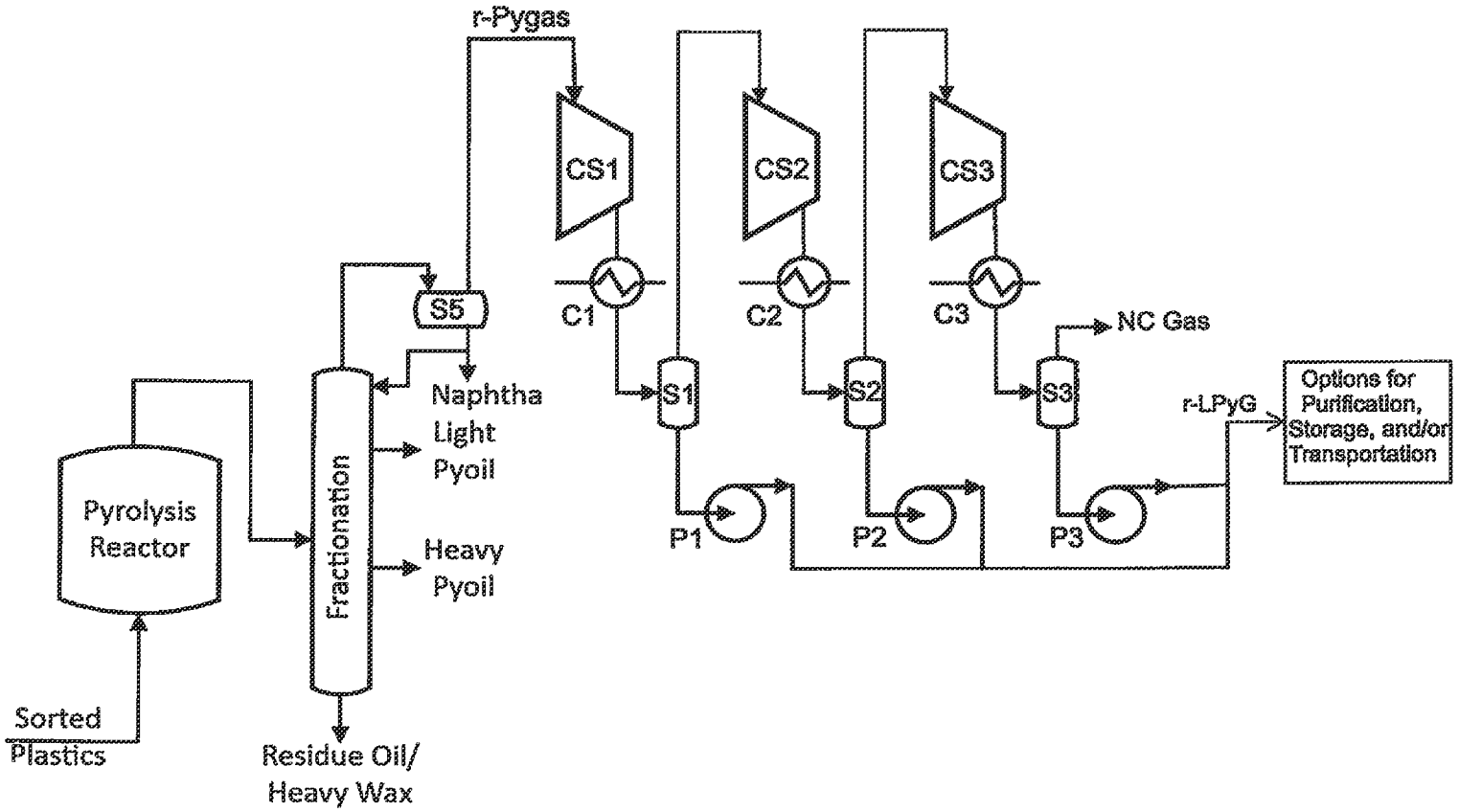
FIG. 2 is a block flow diagram illustrating the main steps of a process and facility for producing r-LPyG in accordance with a first embodiment of the present technology.

FIG. 2 provides a more detailed view of the pyrolysis, separation, and liquefaction steps previously introduced with reference to FIG. 1. As shown in FIG. 2, the sorted waste plastic can initially be fed to a pyrolysis reactor. The pyrolysis reaction involves chemical and thermal decomposition of the sorted waste plastic. Although all pyrolysis processes may be generally characterized by a reaction environment that is substantially free of oxygen, pyrolysis processes may be further defined, for example, by the pyrolysis reaction temperature within the reactor, the residence time in the pyrolysis reactor, the reactor type, the pressure within the pyrolysis reactor, and the presence or absence of pyrolysis catalysts.

The pyrolysis reactor depicted in FIG. 2 can be, for example, a film reactor, a screw extruder, a tubular reactor, a tank, a stirred tank reactor, a riser reactor, a fixed bed reactor, a fluidized bed reactor, a rotary kiln, a vacuum reactor, a microwave reactor, or an autoclave.

The pyrolysis reaction can involve heating and converting the waste plastic feedstock in an atmosphere that is substantially free of oxygen or in an atmosphere that contains less oxygen relative to ambient air. For example, the atmosphere within the pyrolysis reactor may comprise not more than 5, not more than 4, not more than 3, not more than 2, not more than 1, or not more than 0.5 weight percent of oxygen.

The temperature in the pyrolysis reactor can be adjusted so as to facilitate the production of certain end products. In an embodiment or in combination with any embodiment mentioned herein, the peak pyrolysis temperature in the pyrolysis reactor can be at least 325° C., or at least 350° C., or at least 375° C., or at least 400° C. Additionally or alternatively, the peak pyrolysis temperature in the pyrolysis reactor can be not more than 800° C., not more than 700° C., or not more than 650° C., or not more than 600° C., or not more than 550° C., or not more than 525° C., or not more than 500° C., or not more than 475° C., or not more than 450° C., or not more than 425° C., or not more than 400° C. More particularly, the peak pyrolysis temperature in the pyrolysis reactor can range from 325 to 800° C., or 350 to 600° C., or 375 to 500° C., or 390 to 450° C., or 400 to 500° C.

The residence time of the feedstock within the pyrolysis reactor can be at least 1, or at least 5, or at least 10, or at least 20, or at least 30, or at least 60, or at least 180 seconds. Additionally, or alternatively, the residence time of the feedstock within the pyrolysis reactor can be less than 2, or less than 1, or less than 0.5, or less than 0.25, or less than 0.1 hours. More particularly, the residence time of the feedstock within the pyrolysis reactor can range from 1 second to 1 hour, or 10 seconds to 30 minutes, or 30 seconds to 10 minutes.

The pyrolysis reactor can be maintained at a pressure of at least 0.1, or at least 0.2, or at least 0.3 barg and/or not more than 60, or not more than 50, or not more than 40, or not more than 30, or not more than 20, or not more than 10, or not more than 8, or not more than 5, or not more than 2, or not more than 1.5, or not more than 1.1 barg. The pressure within the pyrolysis reactor can be maintained at atmospheric pressure or within the range of 0.1 to 60, or 0.2 to 10, or 0.3 to 1.5 barg.

The pyrolysis reaction in the reactor can be thermal pyrolysis, which is carried out in the absence of a catalyst, or catalytic pyrolysis, which is carried out in the presence of a catalyst. When a catalyst is used, the catalyst can be homogenous or heterogeneous and may include, for example, certain types of zeolites and other mesostructured catalysts.

In the embodiment depicted in FIG. 2, the pyrolysis effluent exiting the pyrolysis reactor can be subjected to separation in a fractionation column and a separator S5. As depicted in FIG. 2, the pyrolysis effluent fed to the fractionation column can be separated into a residual (residue) oil/heavy wax fraction, a heavy pyoil fraction, a light pyoil fraction, and an overhead vapor. The overhead vapor from the fractionation column can be fed to separator S5 which separates it into a liquid naphtha fraction and a gaseous r-pygas fraction. At least a portion of the liquid naphtha exiting separator S5 can be introduced as reflux into an upper inlet of the fractionation column.

In an embodiment or in combination with any embodiment mentioned herein, the r-pygas exiting the top of separator S5 can have the composition shown below in Table 1.

TABLE 1

| r-Pygas Composition | | | | | | |
|---|---|---|---|---|---|---|
| | | End Points | | Ranges | | |
| Component | Units | More than . . . | Not To Exceed or Less than . . . | Broad | Middle | Narrow |
| C1-C5 | Wt. % | 50, 75, 90, 95 | 99.9, 99.5, 99, 98 | 50-99.99 | 75-99.5 | 90-99 |
| C1-C2 | Wt. % | 0.0, 0.01, 0.1, 1, 5 | 40, 30, 20, 15 | 0.01-40 | 1-30 | 5-20 |
| Ethane and Lighter | Liq. Vol. % | 0.0, 0.01, 1, 2, 4 | 20, 10, 5, 4, 2 | 0-20 | 0.1-10 | 2-5 |
| C2-C4 | Wt. % | 25, 50, 75, 80 | 99, 98, 95, 90 | 25-99 | 50-98 | 75-95 |
| C3-C5 | Wt. % | 50, 60, 70, 80, 90, 95 | 99.9, 99.5, 99, 98, 97, 96, 95 | 50-99.5 | 80-99 | 90-98 |
| C5+ | Wt. % | 0.0, 0.01, 0.1, 0.5, 1 | 50, 25, 10, 5, 1 | 0.01-50 | 0.1-25 | 0.5-5 |
| C6+ | Wt. % | 0.0, 0.01, 0.1, 0.5, 1 | 25, 10, 5, 1, 0.05 | 0.0-25 | 0.01-5 | 0.5-1 |
| C2 | Wt. % | 0.01, 0.1, 1, 5 | 40, 30, 20, 15 | 0.01-40 | 1-30 | 5-20 |
| C3 | Wt. % | 1, 10, 20, 30 | 99, 80, 60, 50 | 0.1-80 | 10-40 | 30-50 |
| C4 | Wt. % | 1, 5, 15, 20 | 95, 75, 50, 40 | 1-95 | 5-75 | 15-40 |
| C5 | Wt. % | 0.1, 1, 2, 5 | 90, 50, 25, 15 | 0.1-90 | 1-20 | 2-25 |
| Methane | Wt. % | 0.0, 0.01, 0.1, 1, 2 | 20, 10, 5, 1 | 0-20 | 0.1-10 | 1-5 |
| Ethane | Wt. % | 0.01, 0.1, 1, 5 | 40, 30, 20, 15 | 0.01-40 | 1-30 | 5-20 |
| Ethylene | Wt. % | 0.01, 0.1, 0.5, 1 | 50, 25, 10, 5 | 0.01-50 | 0.1-25 | 0.5-10 |
| Propane | Wt. % | 0.01, 0.1, 1, 5 | 50, 40, 30, 20 | 0.01-50 | 1-30 | 5-20 |
| Propylene | Wt. % | 0.5, 1, 5, 15, 20 | 95, 75, 50, 40 | 0.5-95 | 5-75 | 15-40 |

TABLE 1-continued

| r-Pygas Composition | | | | | | |
|---|---|---|---|---|---|---|
| | | End Points | | | | |
| | | | Not To Exceed or | Ranges | | |
| Component | Units | More than . . . | Less than . . . | Broad | Middle | Narrow |
| Butanes | Wt. % | 0.1, 1, 2, 5 | 90, 50, 25, 15 | 0.1-90 | 1-20 | 2-25 |
| Butylenes | Wt. % | 0.0, 0.01, 0.1, 1, 5 | 30, 15, 10, 5 | 0.01-30 | 0.1-15 | 0.5-5 |
| Butenes | Wt. % | 0.0, 0.01, 0.1, 1, 5 | 50, 40, 30, 25 | 0.01-50 | 1-40 | 5-25 |
| Butadienes | Wt. % | 0.0, 0.001, 0.01, 0.1, 1 | 10, 1, 0.1, .01 | 0-10 | 0-1 | 0.001-0.1 |
| Pentanes | Wt. % | 0.0, 0.1, 1, 2, 5 | 90, 50, 25, 15 | 0.1-90 | 1-20 | 2-25 |
| Pentenes | Wt. % | 0.0, 0.001, 0.01, 0.1, 1 | 20, 10, 5, 1 | 0-20 | 0-10 | 0.01-5 |
| Pentadienes | Wt. % | 0.0, 0.001, 0.01, 0.1, 1 | 10, 1, 0.1, .01 | 0-10 | 0-1 | 0.001-0.1 |
| Alkanes | Wt. % | 10, 20, 30, 40 | 80, 70, 60, 50 | 10-80 | 20-70 | 30-60 |
| Hydrogen | Wt. % | 0.0, 0.001, 0.01, 0.1, 1 | 10, 1, 0.1, 0.01 | 0-10 | 0-1 | 0.001-0.1 |
| H2O | Wt. % | 0.0, 0.001, 0.01, 0.025 | 5, 2, 1, 0.1, 0.01 | 0.0-5 | 0.0-1 | 0.001-0.1 |
| CO | ppmw | 0.0, 0.05, 0.1, 0.5, 1 | 50, 10, 5, 1, 0.5 | 0.0-50 | 0.05-5 | 0.5-1 |
| CO2 | ppmw | 0.0, 0.1, 0.5, 1, 1.5, 2 | 100, 50, 25, 5, 1 | 0.0-100 | 0.1-25 | 1-5 |
| CO*x* | ppmw | 0.0, 0.1, 0.5, 1, 1.5, 2 | 200, 75, 10, 5, 1 | 0.0-200 | 0.1-75 | 1.5-10 |
| Total Org. Oxygenates | ppmw | 0.0, 0.1, 0.5, 1, 1.5, 2 | 100, 50, 25, 5, 1 | 0.0-100 | 0.1-25 | 1-5 |
| Total Sulfur (ppmw) | ppmw | 0.0, 0.001, 0.01, 0.025, 0.05 | 200, 100, 50, 25, 15, 5 | 0.0-200 | 0.001-50 | 0.025-15 |
| Arsine | ppbw | 0.0 | 1000, 400, 200, 100 | — | — | — |
| Total Nitrogen | ppmw | 0.0 | 100, 50, 20, 10, 5 | — | — | — |
| Nitrogen as N2 | ppmw | 0.0 | 100, 50, 25, 15, 5 | — | — | — |
| Methyl Acetate | ppmw | 0.0 | 100, 50, 20, 10, 5 | — | — | — |
| Propadiene | ppmw | 0.0 | 100, 50, 20, 10, 5 | — | — | — |
| Methanol | ppmw | 0.0 | 50, 25, 10, 5, 1 | — | — | — |
| Total Chlorine | ppmw | 0.0 | 50, 25, 10, 5, 1 | — | — | — |
| Oxygen as O2 | ppmw | 0.0 | 50, 25, 10, 5, 1 | — | — | — |

As used herein, the term "Cx" or "Cx hydrocarbon," refers to a hydrocarbon compound including "x" total carbons per molecule, and encompasses all olefins, paraffins, aromatics, heterocyclic, and isomers having that number of carbon atoms. For example, each of normal, iso, and tert-butane and butene and butadiene molecules would fall under the general description "C4."

It should be noted that the separation scheme (i.e., the fractionation column and separator S5) depicted in FIG. 2 is just one example of a scheme for separating the pyrolysis effluent into useful fractions. Other separation schemes can be implemented depending on the circumstances.

As shown in FIG. 2, the r-pygas can be liquified by subjecting it to one or more compression steps/stages (e.g. CS1, CS2, and CS3), one or more cooling steps (e.g., C1, C2, and C3), one or more separation steps (e.g., S1, S2, and S3), and one or more pumping steps (e.g., P1, P2, and P3).

Although FIG. 2 illustrates three compression steps/stages, the number of compression stages can range from 1 to 15, or from 2 to 10, or from 3 to 6. Each compression stage can provide a pressure increase such that the outlet pressure of each stage is 1.5 to 3.5, or 1.75 to 3.0, or 2 to 2.5 times greater than the inlet pressure of the stage.

In an embodiment or in combination with any embodiment mentioned herein, the inlet pressure to compressor stage CS1 can be 1 to 4, or 1.1 to 2.5, or 1.2 to 1.8 barg; the outlet pressure of compressor stage CS1 and the inlet pressure to CS2 can be 2.0 to 6.0, or 3.0 to 4.0, or 3.2 to 3.8 barg; the outlet pressure of compressor stage CS2 and the inlet pressure to CS3 can be 6 to 12, or 7 to 11, or 8 to 10 barg; and the outlet pressure from compressor stage CS3 can be 15 to 35, 18 to 28, or 20 to 25 barg.

The cooling carried out after each compression stage can be sufficient to cause at least a portion of the effluent from the preceding compression stage to condense. Such cooling can be carried out using indirect heat exchange with a cooling fluid (such as cooling water) in heat exchangers C1, C2, and C3.

As shown in FIG. 2, the cooled streams exiting heat exchangers C1, C2, and C3 can then be subjected to vapor-liquid separation in separators S1, S2, and S3, respectively. The separated vapors from the tops of separators S1 and S2 are fed to compression stages CS2 and CS3, respectively. The separated vapors from the top of separator S3 comprises non-condensable gas. The separated liquids from the bottoms of separators S1, S2, and S3 are pumped via pumps P1, P2, and P3, respectively, to a r-LPyG storage and/or transportation apparatus. The r-LPyG stream removed from the pyrolysis and liquification site/facility shown in FIG. 2 is the combination of the liquid streams removed from each of separators S1, S2, and S3.

Figure 6:
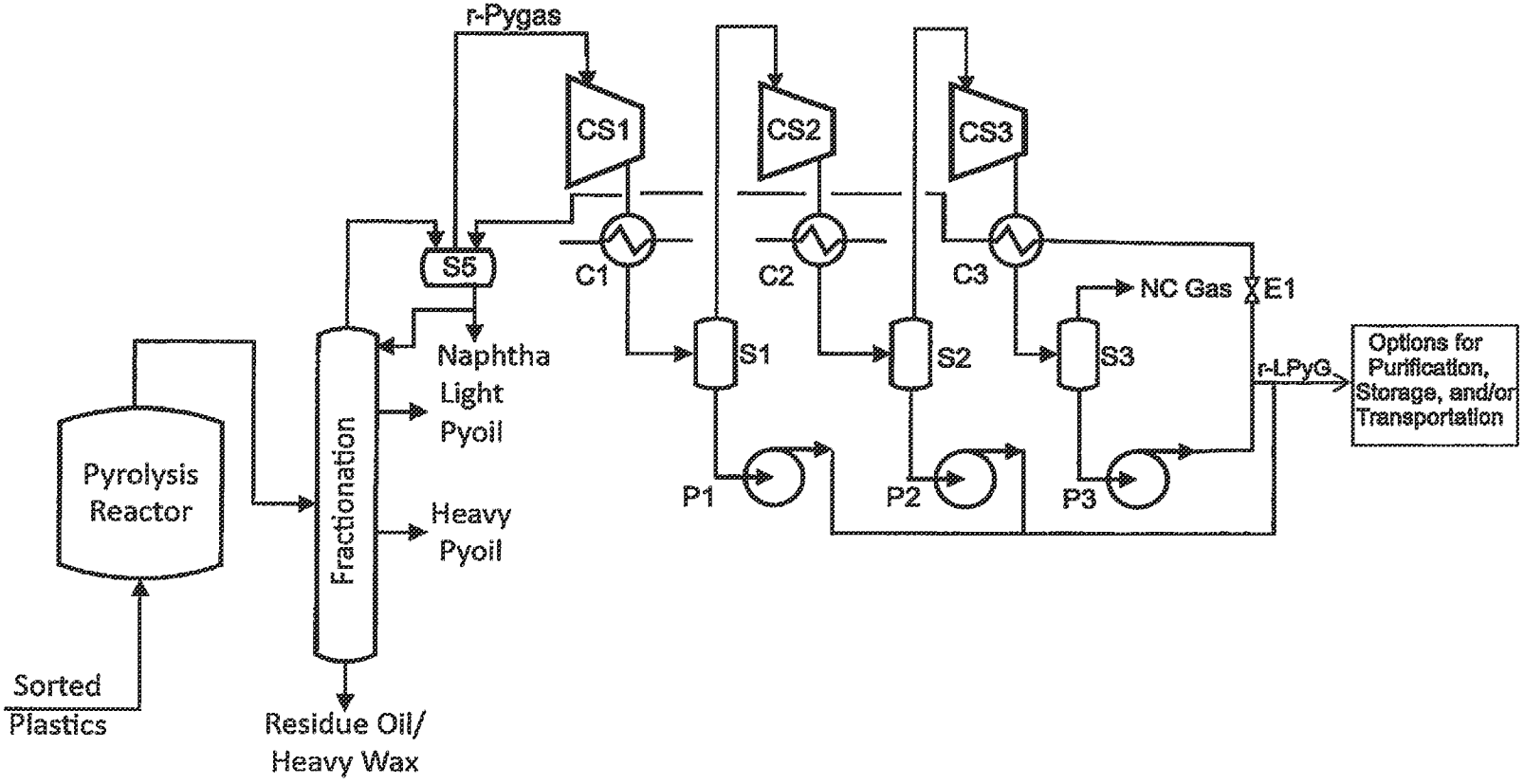
FIG. 6 is a block flow diagram illustrating the main steps of a process and facility for producing r-LPyG in accordance with a second embodiment of the present technology.

FIG. 6 shows a pyrolysis and r-pygas liquification process and system similar to the one depicted in FIG. 2, however the system of FIG. 6 includes self-refrigeration to enhance recovery of C3-C5 compounds in the r-LpyG. Specifically, the embodiment depicted in FIG. 6 takes a portion of the liquid effluent from pump P3 and routes it through an expander E1, where its pressure is reduced and it is cooled. The resulting cooled stream from expander E1 is then used in heat exchanger C3 to cool the compressed fluid discharged from compression stage CS3. In this way, a portion of compressed fluid discharged from compression stage CS3 is used for self-refrigeration in heat exchanger C3. The stream from expander E1 used to cool the fluid discharged from compression stage CS3 is heated in the heat exchanger C3 and then routed to the separator S5.

Figure 7:
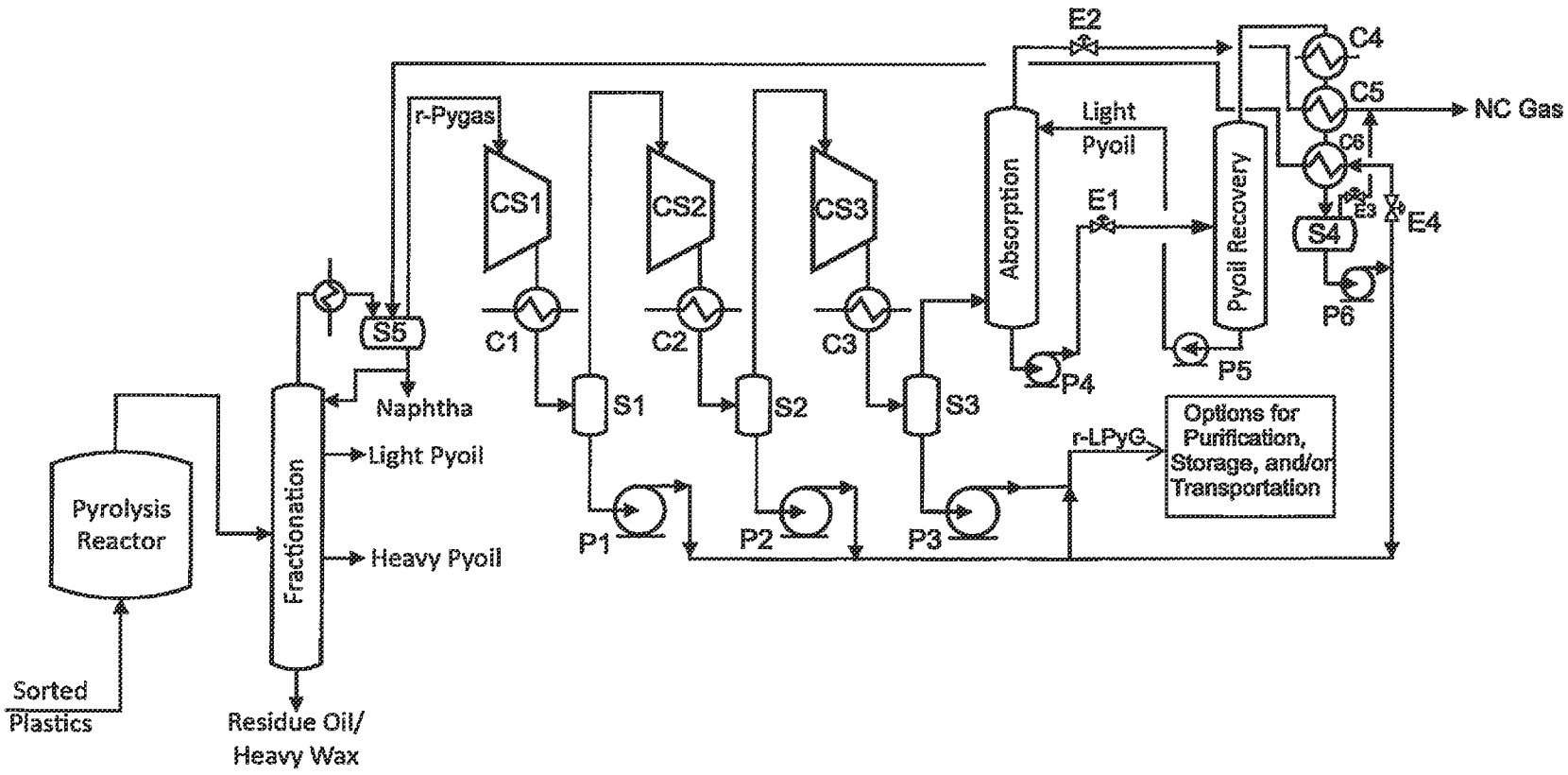
FIG. 7 is a block flow diagram illustrating the main steps of a process and facility for producing r-LPyG in accordance with a third embodiment of the present technology.

FIG. 7 shows a pyrolysis and r-pygas liquification process and system similar to the ones depicted in FIGS. 2 and 6, however the system of FIG. 7 includes absorption and self-refrigeration to enhance recovery of C3-C5 compounds in the r-LpyG.

The initial steps of the system depicted in FIG. 7 can be the same as those depicted in FIGS. 2 and 3. However, in FIG. 7, the overhead vapor stream from separator S3, which can be referred to as a "wet gas," is be fed to an absorber for recovery of C2-C5 components present in the wet gas. A light pyoil stream, described in further detail below, is fed to an upper inlet of the absorber for use as the absorption liquid. In the absorber, the downwardly flowing liquid light pyoil contacts the upwardly flowing wet gas and the liquid light pyoil absorbs C2-C5 components from the wet gas. A liquid rich oil stream containing the absorbed C2-C5 component exits a bottom outlet of the absorber, while a dry gas stream exits a top outlet of the absorber.

The rich oil stream exiting the bottom of the absorber is pumped by pump P4 to an expander E1, where its pressure is let down to cause cooling of the rich oil stream. From expander E1, the cooled rich oil stream is fed to a pyoil recovery column, which separates the cooled rich oil stream from expander E1 into a liquid light pyoil stream and an overhead vapor stream. The liquid light pyoil stream exits a bottom outlet of the pyoil recovery column and is then pumped via a pump P5 to the upper inlet of the absorber for use as the absorption liquid. In certain embodiments, all or part of the naphtha and light pyoil streams produced by the separation system (e.g., fractionation column and separator S5) immediately downstream of the pyrolysis reactor can be used as all or part of the absorption liquid fed to the upper inlet of the absorption column.

The overhead vapor stream exiting the pyoil recovery column is sequentially cooled in heat exchangers C4 (via cooling water), C5 (via expanded non-condensable gas), and C6 (via expanded r-LPyG) to thereby cause condensing of at least a portion of the overhead stream. The resulting cooled stream is supplied to a separator S4 for separation into a dry gas stream and a liquid stream comprising C2-C5 components. The liquid stream exiting the separator S4 then passes to a pump P6. The pump P6 pumps a first portion of the liquid stream to the r-LPyG storage and/or transportation apparatus (e.g., tank or pipeline). A second portion of the liquid stream exiting the pump P6 can be passed through an expander E4, where its pressure is let down and it is cooled. The cooled stream from expander E4 is then used in heat exchanger C6 to cool the overhead stream from the pyoil recovery column.

The non-condensable dry gas exiting the upper outlet of the absorber is passed through an expander E2, where its pressure is reduced to cause cooling of the non-condensable gas stream. The cooled non-condensable gas from expander E2 is then passed through the heat exchanger C5 and used to cool the vapor stream exiting the overhead of the pyoil recovery column. After being warmed in the heat exchanger C5, the non-condensable ("NC Gas in FIG. 4) gas can exit the process, or all or part of the NC gas can be used as fuel to provide heat for the pyrolysis reaction.

In an embodiment or in combination with any embodiment mentioned herein, the systems depicted in FIGS. 2, 6, and 7 can produce a crude (mixed) r-LPyG having a composition summarized in Table 2, below.

TABLE 2

| Mixed r-LPyG Composition | | | | | | |
|---|---|---|---|---|---|---|
| | | End Points | | Ranges | | |
| Component | Units | More than . . . | Not To Exceed or Less than . . . | Broad | Middle | Narrow |
| C1-C5 | Wt. % | 50, 75, 90, 95 | 99.9, 99.5, 99, 98 | 50-99.99 | 75-99.5 | 90-99 |
| C1-C2 | Wt. % | 0.0, 0.01, 0.1, 1, 5 | 40, 30, 20, 15 | 0.01-40 | 1-30 | 5-20 |
| Ethane and Lighter | Liq. Vol. % | 0.0, 0.001, 0.01, 0.02, 0.05 | 10, 5, 2, 1, 0.5 | 0-10 | 0.001-5 | 0.02-2 |
| C2-C4 | Wt. % | 25, 50, 75, 80 | 99, 98, 95, 90 | 25-99 | 50-98 | 75-95 |
| C3-C5 | Wt. % | 75, 90, 95, 97, 98, 99 | 99.99, 99.9, 99.5, | 75-99.99 | 95-99.9 | 97-99.5 |
| C5+ | Wt. % | 0.0, 0.01, 0.1, 0.5, 1 | 50, 25, 10, 5, 1 | 0.01-50 | 0.1-25 | 0.5-5 |
| C6+ | Wt. % | 0.0, 0.01, 0.1, 0.5, 1 | 25, 10, 5, 1, 0.05 | 0.0-25 | 0.01-5 | 0.5-1 |
| C2s | Wt. % | 0.01, 0.1, 1, 5 | 40, 30, 20, 15 | 0.01-40 | 1-30 | 5-20 |
| C3s | Wt. % | 1, 10, 20, 30 | 99, 80, 60, 50 | 0.1-80 | 10-40 | 30-50 |

TABLE 2-continued

| Mixed r-LPyG Composition | | | | | | |
|---|---|---|---|---|---|---|
| | | End Points | | Ranges | | |
| Component | Units | More than . . . | Not To Exceed or Less than . . . | Broad | Middle | Narrow |
| C4s | Wt. % | 1, 5, 15, 20 | 95, 75, 50, 40 | 1-95 | 5-75 | 15-40 |
| C5s | Wt. % | 0.1, 1, 2, 5 | 90, 50, 25, 15 | 0.1-90 | 1-20 | 2-25 |
| Methane | Wt. % | 0.0, 0.001, 0.01, 0.1, 1 | 10, 1, 0.1, .01 | 0-10 | 0-1 | 0.001-0.1 |
| Ethane | Wt. % | 0.01, 0.1, 1, 5 | 40, 30, 20, 15 | 0.01-40 | 1-30 | 5-20 |
| Ethylene | Wt. % | 0.01, 0.1, 0.5, 1 | 50, 25, 10, 5 | 0.01-50 | 0.1-25 | 0.5-10 |
| Propane | Wt. % | 0.01, 0.1, 1, 5 | 50, 40, 30, 20 | 0.01-50 | 1-30 | 5-20 |
| Propylene | Wt. % | 0.5, 1, 5, 15, 20 | 95, 75, 50, 40 | 0.5-95 | 5-75 | 15-40 |
| Butanes | Wt. % | 0.1, 1, 2, 5 | 90, 50, 25, 15 | 0.1-90 | 1-20 | 2-25 |
| Butylenes | Wt. % | 0.0, 0.01, 0.1, 1, 5 | 30, 15, 10, 5 | 0.01-30 | 0.1-15 | 0.5-5 |
| Butenes | Wt. % | 0.0, 0.01, 0.1, 1, 5 | 50, 40, 30, 25 | 0.01-50 | 1-40 | 5-25 |
| Butadienes | Wt. % | 0.0, 0.001, 0.01, 0.1, 1 | 10, 1, 0.1, .01 | 0-10 | 0-1 | 0.001-0.1 |
| Pentanes | Wt. % | 0.0, 0.1, 1, 2, 5 | 90, 50, 25, 15 | 0.1-90 | 1-20 | 2-25 |
| Pentenes | Wt. % | 0.0, 0.001, 0.01, 0.1, 1 | 20, 10, 5, 1 | 0-20 | 0-10 | 0.01-5 |
| Pentadienes | Wt. % | 0.0, 0.001, 0.01, 0.1, 1 | 10, 1, 0.1, .01 | 0-10 | 0-1 | 0.001-0.1 |
| Alkanes | Wt. % | 10, 20, 30, 40 | 80, 70, 60, 50 | 10-80 | 20-70 | 30-60 |
| Hydrogen | Wt. % | 0.0, 0.001, 0.01, 0.1, 1 | 10, 1, 0.1, .01 | 0-10 | 0-1 | 0.001-0.1 |
| H2O | Wt. % | 0.0, 0.001, 0.01, 0.025 | 5, 2, 1, 0.1, 0.01 | 0.0-5 | 0.0-1 | 0.001-0.1 |
| CO | ppmw | 0.0, 0.05, 0.1, 0.5, 1 | 50, 10, 5, 1, 0.5 | 0.0-50 | 0.05-5 | 0.5-1 |
| CO2 | ppmw | 0.0, 0.1, 0.5, 1, 1.5, 2 | 100, 50, 25, 5, 1 | 0.0-100 | 0.1-25 | 1-5 |
| CO*x* | ppmw | 0.0, 0.1, 0.5, 1, 1.5, 2 | 200, 75, 10, 5, 1 | 0.0-200 | 0.1-75 | 1.5-10 |
| Total Org. Oxygenates | ppmw | 0.0, 0.1, 0.5, 1, 1.5, 2 | 100, 50, 25, 5, 1 | 0.0-100 | 0.1-25 | 1-5 |
| Total Sulfur (ppmw) | ppmw | 0.0, 0.001, 0.01, 0.025, 0.05 | 200, 100, 50, 25, 15, 5 | 0.0-200 | 0.001-50 | 0.025-15 |
| Arsine | ppbw | 0.0 | 1000, 400, 200, 100 | — | — | — |
| Total Nitrogen | ppmw | 0.0 | 100, 50, 20, 10, 5 | — | — | — |
| Nitrogen as N2 | ppmw | 0.0 | 100, 50, 25, 15, 5 | — | — | — |
| Methyl Acetate | ppmw | 0.0 | 100, 50, 20, 10, 5 | — | — | — |
| Propadiene | ppmw | 0.0 | 100, 50, 20, 10, 5 | — | — | — |
| Methanol | ppmw | 0.0 | 50, 25, 10, 5, 1 | — | — | — |
| Total Chlorine | ppmw | 0.0 | 50, 25, 10, 5, 1 | — | — | — |
| Oxygen as O2 | ppmw | 0.0 | 50, 25, 10, 5, 1 | — | — | — |

Figure 5A:
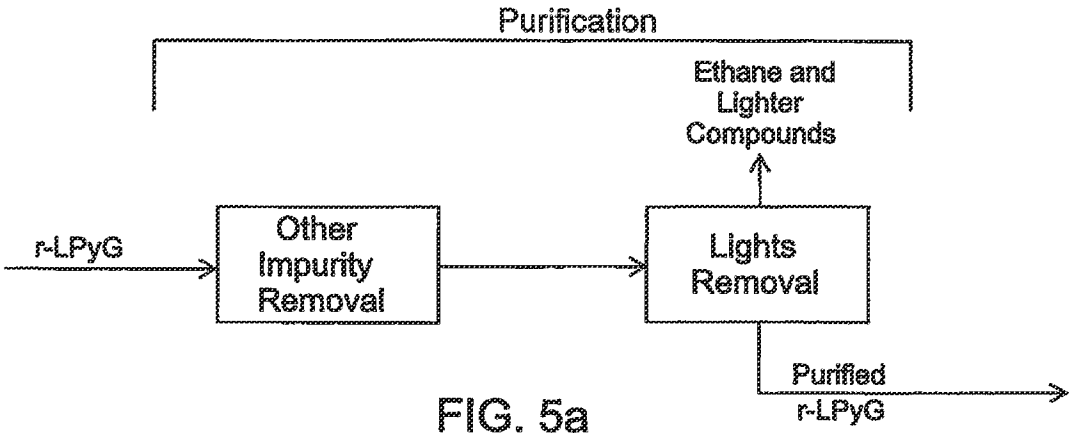
FIG. 5*a* is a block flow diagram illustrating the main steps of a process and facility for purifying r-LPyG to form premium (purified) r-LPyG according to a first embodiment of the present invention.
Figure 5B:
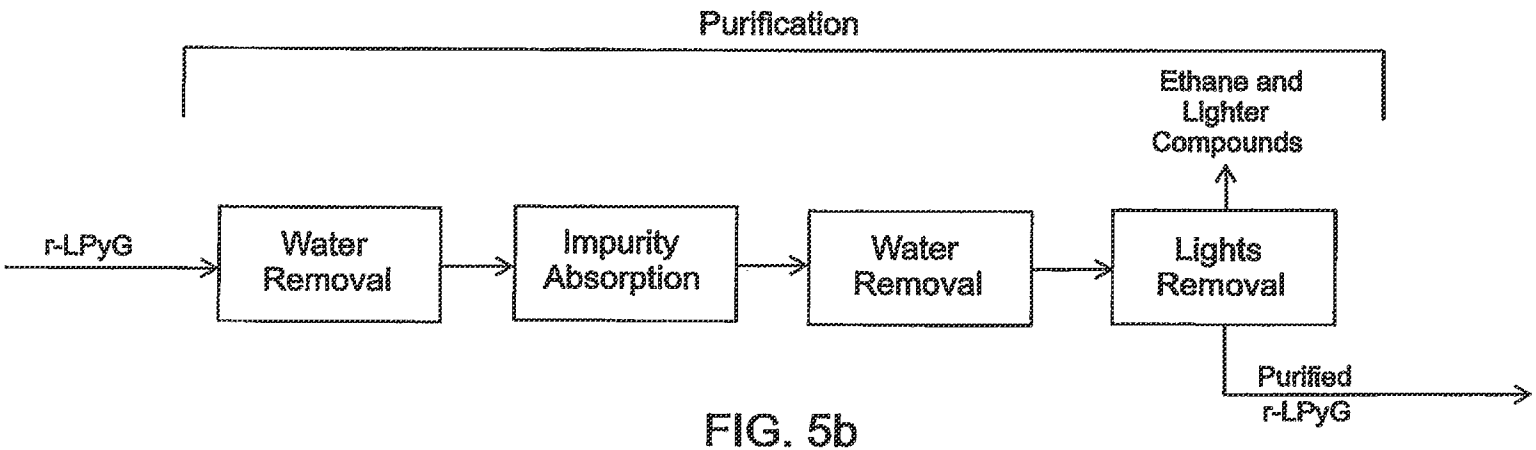
FIG. 5*b* is a block flow diagram illustrating the main steps of a process and facility for purifying r-LPyG to form premium (purified) r-LPyG according to a second embodiment of the present invention.

As shown in FIGS. 2, 6, and 7, the r-LPyG from the liquification section can be purified, as well as stored and/or transported at and between various points of the process and/or locations, as described with respect to FIGS. 3*a-c* and 4*a-g*. FIGS. 5*a* and 5*b* show embodiments of purification processes and systems that can be used to remove one or more undesired components from an r-LPyG stream. As shown in FIG. 5*a*, the r-LPyG stream can pass through one or more impurity removal steps/stages before having the ethane and lighter compounds separated out in a lights removal zone to provide purified (premium) r-LPyG. The impurity removal step can include, for example, one or more beds of solid absorbent material for adsorbing or absorbing one or more impurities (such as water, sulfur, chlorides, organic oxygenates, nitrogen, arsenic, mercury, and/or silicon) from the r-LPyG stream. Suitable absorbent materials can comprise a metal or a non-metal and can include, but are not limited to, alumina, silica, aluminosilicates, molecular sieve, zeolite, pallidum oxide, and combinations thereof. Alternatively, or in addition, a liquid absorbent such as amine or caustic can also be used to remove one or more impurities.

As shown in FIG. 5*a*, after the impurity removal step/stage, the r-LPyG can pass through one or more distillation columns, wherein the light and/or heavy hydrocarbon components can be removed. In one embodiment, shown in FIG. 5*a*, ethane and lighter components can be removed from the r-LPyG stream, so that the purified r-LPyG stream includes less than 500, less than 200, less than 100, or less than 50 parts per million by weight (ppmw) of ethane and lighter components. As needed (not shown in FIG. 5*a*), the C6 and heavier components can also be removed so that the purified r-LPyG stream includes less than 2, less than 1, or less than 0.5 weight percent of C6 and heavier components. The resulting r-LPyG stream can include at least 90, at least 92, at least 95, at least 97, at least 98, at least 99, or at least 99.9 weight percent of C3 to C5 components.

FIG. 5*b* provides another embodiment of a purification process or facility that includes a water removal (drying) step before and after the removal of other impurities. The water removal step can be carried out using a bed of solid absorbent (such as molecular sieve or carbon) and may reduce the water content to near zero prior to the lights removal step. The dew point of the purified r-LPyG can be less than 0, less than −25, less than −50, less than −75, or less than −100° F.

In an embodiment or in combination with any embodiment mentioned herein, the purified (premium) r-LPyG can have the composition shown below in Table 3.

TABLE 3

Premium r-LPyG Composition

| | | End Points | | Ranges | | |
|---|---|---|---|---|---|---|
| Component | Units | More than . . . | Not to Exceed or Less than . . . | Broad | Middle | Narrow |
| C1-C5 | Wt. % | 95, 97, 98, 99, 99.5, 99.9, 99.99 | 100, 99.99, 99.9, 99.5 | 95-100 | 99-99.99 | 98-99.9 |
| C1-C2 | Wt. % | 0.0, 0.01, 0.1, 1, 2 | 40, 30, 20, 10, 5 | 0.01-40 | 1-30 | 2-10 |
| Ethane and Lighter | ppmw | 1, 10, 50, 100, 150 | 10000, 1000, 500, 200, 100, 50 | 1-10000 | 10-1000 | 50-200 |
| C2-C4 | Wt. % | 90, 95, 97, 98, 99, 99.5, 99.9 | 100, 99.99, 99.9, 99.5 | 90-100 | 95-99.99 | 98-99.9 |
| C3-C5 | Wt. % | 90, 95, 97, 98, 99, 99.5, 99.9 | 100, 99.99, 99.9, 99.5 | 90-100 | 95-99.99 | 98-99.9 |
| C5+ | Wt. % | 0.0, 0.01, 0.1, 0.5, 1 | 50, 25, 10, 5, 1 | 0.01-50 | 0.1-25 | 0.5-5 |
| C6+ | Wt. % | 0.0, 0.01, 0.1, 0.5, 1 | 25, 10, 5, 2 1, 0.05 | 0.0-25 | 0.01-5 | 0.1-1 |
| C2s | Wt. % | 0.0, 0.01, 0.1, 1, 2 | 40, 30, 20, 10, 5 | 0.01-40 | 1-30 | 2-10 |
| C3s | Wt. % | 1, 10, 20, 30, 40, 50 | 95, 80, 60, 50 | 1-95 | 10-80 | 40-60 |
| C4s | Wt. % | 1, 10, 20, 30, 35, 45 | 95, 75, 55, 45 | 1-95 | 15-75 | 35-55 |
| C5s | Wt. % | 0.0, 0.01, 0.1, 0.5, 1 | 25, 10, 5, 1, 0.05 | 0.0-25 | 0.01-5 | 0.1-1 |
| Methane | Wt. % | 0.0, 0.001, 0.01, 0.1, 1 | 10, 1, 0.1, .01 | 0-10 | 0-1 | 0.001-0.1 |
| Ethane | Wt. % | 0.0, 0.001, 0.01, 0.1, 1 | 10, 1, 0.1, .01 | 0-10 | 0-1 | 0.001-0.1 |
| Ethylene | ppmw | 0.001, 0.1, 1, 5 | 500, 100, 50, 20, 10, 5 | 0.001-500 | 0.1-100 | 1-20 |
| Propane | Wt. % | 1, 5, 10, 15, 20 | 60, 40, 30, 25, 20 | 1-60 | 5-40 | 10-30 |
| Propylene | Wt. % | 1, 5, 10, 30, 25 | 70, 60, 50, 40, 30 | 1-70 | 5-60 | 10-40 |
| Butanes | Wt. % | 1, 5, 10, 15 | 50, 40, 30, 20, 15 | 1-50 | 5-40 | 10-20 |
| Butylenes | Wt. % | 0.0, 0.01, 0.1, 1, 2 | 40, 30, 20, 10, 5 | 0.01-40 | 1-30 | 2-10 |
| Butenes | Wt. % | 1, 5, 10, 15, 20 | 60, 50, 35, 25, 20 | 1-60 | 5-50 | 15-35 |
| Butadienes | Wt. % | 0.0, 0.001, 0.01, 0.1, 1 | 10, 1, 0.1, 0.01 | 0-10 | 0-1 | 0.001-0.1 |
| Pentanes | Wt. % | 0.0, 0.001, 0.01, 0.1, 1 | 10, 1, 0.1, 0.01 | 0-10 | 0-1 | 0.001-0.1 |
| Pentenes | Wt. % | 0.0, 0.001, 0.01, 0.1, 1 | 10, 1, 0.1, 0.01 | 0-10 | 0-1 | 0.001-0.1 |
| Pentadienes | Wt. % | 0.0, 0.001, 0.01, 0.1, 1 | 10, 1, 0.1, 0.01 | 0-10 | 0-1 | 0.001-0.1 |
| Alkanes | Wt. % | 5, 10, 20, 30, 40 | 80, 70, 60, 50, 40 | 5-80 | 10-60 | 20-50 |
| Hydrogen | Wt. % | 0.0, 0.001, 0.01, 0.1, 1 | 10, 1, 0.1, .01 | 0-10 | 0-1 | 0.001-0.1 |
| H2O | ppmw | 0.0, 0.1, 5, 10 | 500, 250, 100, 50, 10 | 0.0-500 | 0.1-250 | 5-100 |
| CO | ppmw | 0.0, 0.01, 0.05, 0.1, 0.5 | 100, 50, 10, 1, 0.5, 0.1 | 0.0-100 | 0.01-10 | 0.05-0.5 |
| CO2 | ppmw | 0.0, 0.01, 0.05, 0.1, 0.5 | 250, 100, 50, 10, 1, 0.5 | 0.0-250 | 0.01-50 | 0.05-1 |

TABLE 3-continued

| Premium r-LPyG Composition | | | | | | |
|---|---|---|---|---|---|---|
| | | End Points | | | | |
| | | | Not to Exceed or | Ranges | | |
| Component | Units | More than . . . | Less than . . . | Broad | Middle | Narrow |
| COx | ppmw | 0.0, 0.1, 0.5, 1, 1.5, 2 | 200, 75, 10, 5, 1 | 0.0-200 | 0.1-75 | 1.5-10 |
| Total Org. Oxygenates | ppmw | 0.0, 0.1, 0.5, 1, 1.5, 2 | 100, 50, 25, 5, 1 | 0.0-100 | 0.1-25 | 1-5 |
| Total Sulfur | ppmw | 0.0, 0.001, 0.01, 0.025, 0.05 | 200, 100, 50 25, 15, 5 | 0.0-200 | 0.001-50 | 0.025-15 |
| Arsine | ppbw | 0.0 | 100, 10, 5, 1, 0.1 | — | — | — |
| Total Nitrogen | ppmw | 0.0 | 100, 10, 5, 1, 0.1 | — | — | — |
| Nitrogen as N2 | ppmw | 0.0 | 100, 10, 5, 1, 0.1 | — | — | — |
| Methyl Acetate | ppmw | 0.0 | 100, 50, 20, 10, 5 | — | — | — |
| Propadiene | ppmw | 0.0 | 100, 50, 20, 10, 5 | — | — | — |
| Methanol | ppmw | 0.0 | 50, 25, 10, 5, 1 | — | — | — |
| Total Chlorine | ppmw | 0.0 | 25, 10, 5, 1, 0.5 | — | — | — |
| Oxygen as O2 | ppmw | 0.0 | 50, 10, 1, 0.5, 0.1 | — | — | — |

In an embodiment or in combination with one or more embodiments herein, the combined concentration of C2 and lighter components on a weight basis in the premium r-LPyG is less than 95, less than 90, less than 80, less than 70, less than 60, or less than 50 percent of the combined concentration of C2 and lighter components on a weight basis in the r-LPyG. Alternatively, or in addition, the concentration of C6+ components on a weight basis in the premium r-LPyG is less than less than 95, less than 90, less than 80, less than 70, less than 60, or less than 50 percent of the concentration of C6+ components on a weight basis in the r-LPyG.

Figure 8:
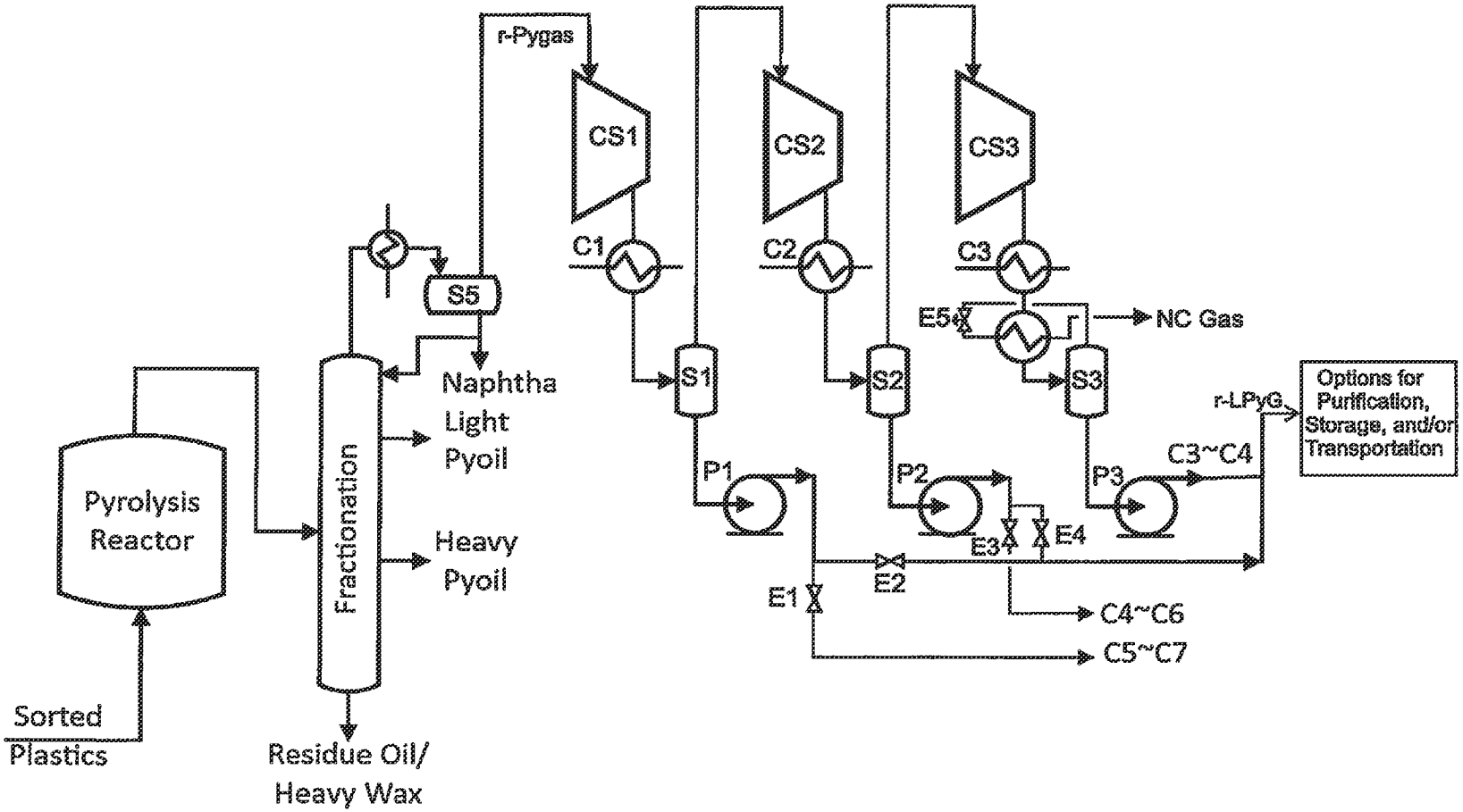
FIG. 8 is a block flow diagram illustrating the main steps of a process and facility for producing premium r-LPyG in accordance with a first embodiment of the present technology.
Figure 9:
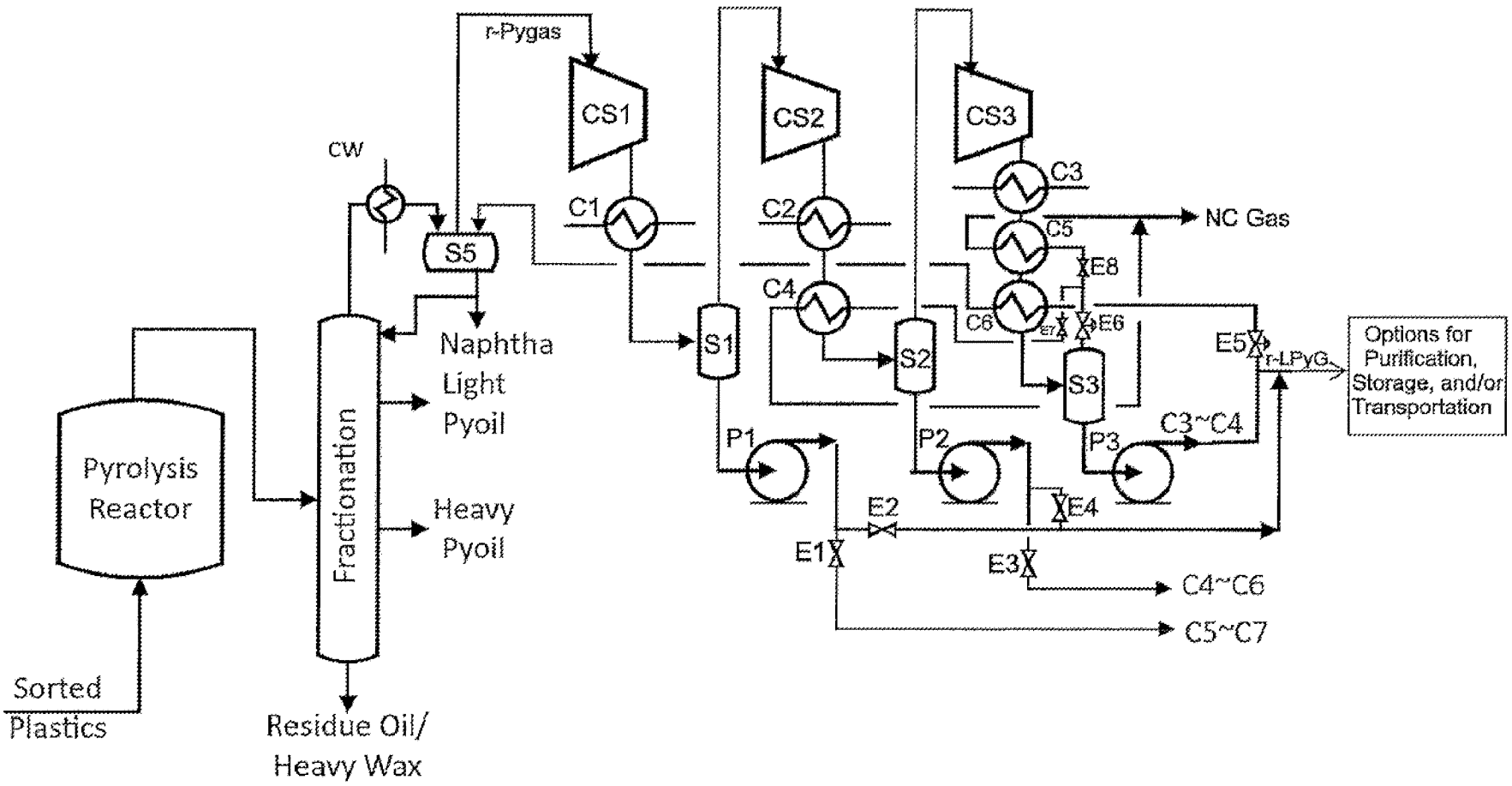
FIG. 9 is a block flow diagram illustrating the main steps of a process and facility for producing premium r-LPyG in accordance with a second embodiment of the present technology.

In some embodiments, the purified r-LPyG can be formed by separating out a premium r-LPyG stream from the liquification section of the pyrolysis process or system. Examples of such configurations are shown in FIGS. 8 and 9. The systems depicted in FIGS. 8 and 9 are similar to those shown in FIGS. 2, 6, and 7. However, streams enriched in certain hydrocarbon components (e.g., C3 and C4, C4 to C6, and C5 to C7) may be withdrawn from various locations within the liquification zone, thereby providing a premium r-LPyG stream. Additional details are provided below, beginning with FIG. 8.

As shown in FIG. 8, the discharge streams from the first and second pumps P1 and P2 can be separated into streams of C3 to C4 components and heavier hydrocarbon streams (C5 to C7 from P1 and C4 to C6 from P2). Each of the streams can be expanded by an expander E1 to E4 and the heavier hydrocarbon streams may be routed to further processing, transportation, storage, and/or use. Each of the C3 to C4 streams may be combined, along with the C3 to C4 stream withdrawn from the outlet of the third pump P3, to form the r-LPyG, which can then be subjected to further purification (to form premium r-LPyG), storage, transportation, and/or end use as described herein.

In an embodiment or in combination with any embodiment mentioned herein, the streams of C5 to C7 and C4 to C6 can include at least 75, at least 80, at least 85, at least 90, or at least 95 weight percent of C5 to C7 or C4 to C6 hydrocarbon components. The stream of C3 and C4 withdrawn from the last pump can include at least 75, at least 80, at least 85, at least 90, or at least 95 weight percent of C3 and C4 components.

Additionally, as shown in FIG. 8, the stream of non-condensable gas withdrawn from the third separator S3 can be expanded via expander E5 and then used to pre-cool the liquid stream from the last compression stage prior to entering separator S3. This condenses out additional heavy components and maximizes C3 and C4 recovery from the stream.

FIG. 9 shows a pyrolysis and r-pygas liquification process and system similar to the one depicted in FIG. 8, however the system of FIG. 9 includes self-refrigeration to enhance recovery of r-LPyG having certain compositions. For example, as shown in FIG. 9, a portion of the C3 and C4 stream withdrawn from the last pump P3 is expanded via expander 5 and used to cool the liquid stream from the last compression stage prior to entering separator S3. Additionally, portions of the overhead stream withdrawn from separator S3 can be expanded via expanders E6 through E8, and the cooled, expanded streams can be used to further cool the feed to the second and third separators S2 and S3 via coolers C4 and C5. The remaining non-condensable gas is removed as an NC stream from the facility.

Figure 10:
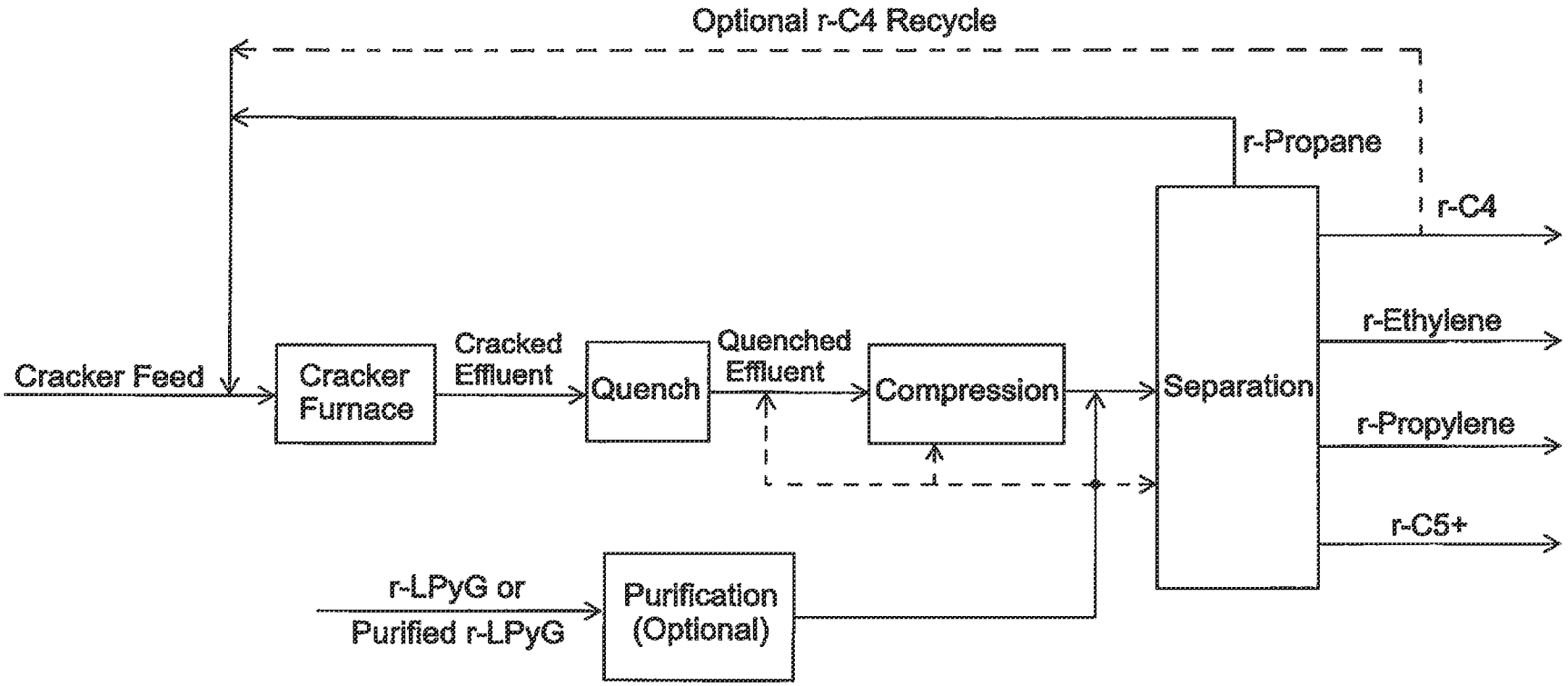
FIG. 10 is a block flow diagram illustrating the main steps of a process and facility for using r-LPyG as a feed to a cracking facility.

FIG. 10 illustrates an embodiment where the premium (purified) r-LPyG (or the r-LPyG) is provided as a feed to an existing or newly built cracking facility. The cracking facility depicted in FIG. 10 includes a cracker feed that is subjected to cracking in a cracker furnace to produce a cracked effluent. The cracked effluent is then subjected to a quench process to produce a quenched effluent. The quenched effluent is subjected to compression and then separation. The separation can be accomplish using a number of different columns/fractionators for separating the stream from the compressor into an r-C5+ stream, an r-ethylene stream, an r-propylene stream, an r-C4 stream, and an r-propane stream.

The feed to the cracking facility be a naphtha-range hydrocarbon feed including, for example, at least 50, at least 75, at least 90, or at least 95 weight percent C5 to C22 components, or it can be a light hydrocarbon feed, including, for example, at least 50, at least 75, at least 90, or at least 95 weight percent C2 to C5 components or C2 and/or C3 alkanes.

The cracking facility depicted in FIG. 10 can be located remotely relative to the waste plastic pyrolysis and r-LPyG production facilities described. Alternatively, the cracking facility depicted in FIG. 10 can be co-located with the waste plastic pyrolysis and r-LPyG production facilities described above.

As illustrated in FIG. 10, the r-LPyG transported to the cracking facility can undergo optional treatment prior to being fed to the cracking facility. Alternatively, the r-LPyG can be fed from the r-LPyG storage and/or transportation apparatus (e.g., railcar tank or pipeline) directly to the cracking facility without requiring any additional treatment.

FIG. 10 shows that the r-LPyG can be introduced into the cracker facility in a variety of locations. Generally, however, the r-LPyG will be introduced downstream of the cracker furnace(s) and upstream of the final fractionator/column in the separation section. Transportation and storage of the r-LPyG and premium r-LPyG between the pyrolysis/liquification site/facility, the purification site/facility, and the cracker site/facility can be performed within the temperature, time, and pressure ranges discussed previously.

When introducing the r-LPyG or premium r-LPyG into the cracking facility, the liquified pygas stream can be introduced into one or more locations within the cracking facility and be combined with the effluent stream from the cracker furnace at that location. For example, as shown in FIG. 10, the r-LPyG or premium r-LPyG can be introduced into the cracking facility at one, two, three, or all four of the following locations: (i) downstream of the quench zone and upstream of the compression zone; (ii) in the compression zone; (iii) downstream of the compression zone and upstream of the separation zone; and (iv) in the separation zone. The r-LPyG or premium r-LPyG stream can be introduced into the inlet of a compression stage or vapor-liquid separator. The r-LPyG or premium r-LPyG can be introduced upstream of a distillation column such as, for example, a demethanizer, a deethanizer, a depropanizer, a debutanizer, a propylene splitter, and/or an ethylene splitter. In some embodiments, a portion of the r-LPyG or premium r-LPyG (or streams including these) can be introduced into one or more of the above locations simultaneously.

When combined with the cracked effluent, the temperature of the r-LPyG (or premium r-LPyG) combined with the cracked effluent stream can be within 5, within 10, within 15, within 20, within 25, or within 50° C. of the temperature of the cracked effluent stream and/or the pressure of the r-LPyG (or premium r-LPyG) can be within 10, within 25, within 50, within 75, or within 100 psig of the temperature of the cracked effluent stream. The combined stream of r-LPyG or premium r-LPyG and cracker effluent can include r-LPyG in an amount of 5 to 95 percent, 10 to 80 percent, or 15 to 75 percent.

Feeding the r-LPyG to the cracker facility allows for recycled content from the r-LPyG to be supplied to the various products of the cracking facility, such as r-ethylene, r-propylene, and r-C5+ compounds. In some cases, the products can include r-ethane, r-propane, and possibly r-butane. In addition, the r-propane, and optionally the r-C4 or r-ethane, present in the r-LPyG can be separated in the separation section combined with the main feed to the cracker furnace, thereby providing recycled content to the cracker feed.

EXAMPLE

In this example, computer modeling is used to simulate a process and system for liquifying recycled content pyrolysis gas (r-pygas). FIG. 11 illustrates the equipment and lines of the r-pygas liquification system, as well as the temperature, pressure, mass flow rate, and molar vapor fraction for each stream. In FIGS. 11, C1, C2, C3, and C4 are compressors; E1, E2, E3, and E4 are heat exchangers; and F1, F2, F3 and F4 are vapor/liquid separators.

The below table provides property and composition details for each of the liquid streams (L1-L4) and vapor streams (V1-V4) shown in FIG. 11.

TABLE 4

Simulation Results for 4-Stage Liquification of r-Pygas (See FIG. 11)

| Stream | — | r-Pygas | L1 | L2 | L3 | L4 | r-LPyG L1 + L2 + L3 + L4 | | V1 | V2 | V3 | V4 |
|---|---|---|---|---|---|---|---|---|---|---|---|---|
| Phase | — | Vap | Liq | Liq | Liq | Liq | Liq | | Vap | Vap | Vap | Vap |
| Temp | F. | 120 | 99 | 99 | 99 | 99 | — | | 99 | 99 | 99 | 99 |
| Press | psia | 19.7 | 255 | 505 | 755 | 1005 | — | | 254 | 504 | 755 | 1005 |
| Mass Flows | lb/hr | 100 | 51.9 | 22.7 | 6.8 | 3.1 | 84.5 | Wt. % | 48.1 | 25.4 | 15.5 | 18.6 |
| Hydrogen | lb/hr | 0.2 | 0.0 | 0.0 | 0.0 | 0.0 | 0.0 | 0.0% | 0.2 | 0.2 | 0.2 | 0.2 |
| Methane | lb/hr | 4.2 | 0.3 | 0.5 | 0.3 | 0.2 | 1.3 | 1.5% | 3.9 | 3.4 | 2.9 | 3.1 |
| Ethane | lb/hr | 11.3 | 2.8 | 2.7 | 1.1 | 0.6 | 7.3 | 8.6% | 8.5 | 5.8 | 4.0 | 4.6 |
| Ethylene | lb/hr | 3.9 | 0.8 | 0.8 | 0.4 | 0.2 | 2.2 | 2.6% | 3.1 | 2.3 | 1.7 | 1.9 |
| Propane | lb/hr | 17.3 | 8.2 | 4.8 | 1.5 | 0.6 | 15.1 | 17.9% | 9.1 | 4.3 | 2.2 | 2.8 |
| Propylene | lb/hr | 24.3 | 10.9 | 6.7 | 2.1 | 0.9 | 20.8 | 24.6% | 13.4 | 6.7 | 3.6 | 4.5 |
| Isobutane | lb/hr | 8.2 | 5.5 | 1.9 | 0.4 | 0.1 | 7.9 | 9.4% | 2.7 | 0.8 | 0.3 | 0.4 |
| Butane | lb/hr | 0.0 | 0.0 | 0.0 | 0.0 | 0.0 | 0.0 | 0.0% | 0.0 | 0.0 | 0.0 | 0.0 |
| Propadiene | lb/hr | 0.0 | 0.0 | 0.0 | 0.0 | 0.0 | 0.0 | 0.0% | 0.0 | 0.0 | 0.0 | 0.0 |
| Acetylene | lb/hr | 0.0 | 0.0 | 0.0 | 0.0 | 0.0 | 0.0 | 0.0% | 0.0 | 0.0 | 0.0 | 0.0 |
| T2-Butene | lb/hr | 8.2 | 5.9 | 1.7 | 0.3 | 0.1 | 8.0 | 9.5% | 2.2 | 0.6 | 0.2 | 0.3 |
| 1-Butene | lb/hr | 10.2 | 7.0 | 2.2 | 0.5 | 0.2 | 9.8 | 11.7% | 3.2 | 0.9 | 0.3 | 0.5 |
| Isobutene | lb/hr | 1.0 | 0.7 | 0.2 | 0.0 | 0.0 | 1.0 | 1.1% | 0.3 | 0.1 | 0.0 | 0.0 |
| C2-Butene | lb/hr | 0.0 | 0.0 | 0.0 | 0.0 | 0.0 | 0.0 | 0.0% | 0.0 | 0.0 | 0.0 | 0.0 |

TABLE 4-continued

Simulation Results for 4-Stage Liquification of r-Pygas (See FIG. 11)

| Stream | — | r-Pygas | L1 | L2 | L3 | L4 | r-LPyG L1 + L2 + L3 + L4 | | V1 | V2 | V3 | V4 |
|---|---|---|---|---|---|---|---|---|---|---|---|---|
| Pentane | lb/hr | 7.6 | 6.6 | 0.9 | 0.1 | 0.0 | 7.6 | 9.0% | 1.0 | 0.1 | 0.0 | 0.0 |
| 1:3-BD | lb/hr | 0.0 | 0.0 | 0.0 | 0.0 | 0.0 | 0.0 | 0.0% | 0.0 | 0.0 | 0.0 | 0.0 |
| M-Acetyl | lb/hr | 0.4 | 0.2 | 0.1 | 0.0 | 0.0 | 0.4 | 0.4% | 0.2 | 0.1 | 0.0 | 0.1 |
| Pentenes | lb/hr | 0.6 | 0.5 | 0.1 | 0.0 | 0.0 | 0.6 | 0.7% | 0.1 | 0.0 | 0.0 | 0.0 |
| Pentadiene | lb/hr | 0.0 | 0.0 | 0.0 | 0.0 | 0.0 | 0.0 | 0.0% | 0.0 | 0.0 | 0.0 | 0.0 |
| CyclC5DI | lb/hr | 0.0 | 0.0 | 0.0 | 0.0 | 0.0 | 0.0 | 0.0% | 0.0 | 0.0 | 0.0 | 0.0 |
| N-Hex-01 | lb/hr | 2.6 | 2.5 | 0.1 | 0.0 | 0.0 | 2.6 | 3.1% | 0.1 | 0.0 | 0.0 | 0.0 |
| CO2 | lb/hr | 0.0 | 0.0 | 0.0 | 0.0 | 0.0 | 0.0 | 0.0% | 0.0 | 0.0 | 0.0 | 0.0 |
| Hydro-01 | lb/hr | 0.0 | 0.0 | 0.0 | 0.0 | 0.0 | 0.0 | 0.0% | 0.0 | 0.0 | 0.0 | 0.0 |
| CO | lb/hr | 0.0 | 0.0 | 0.0 | 0.0 | 0.0 | 0.0 | 0.0% | 0.0 | 0.0 | 0.0 | 0.0 |
| H2O | lb/hr | 0.0 | 0.0 | 0.0 | 0.0 | 0.0 | 0.0 | 0.0% | 0.0 | 0.0 | 0.0 | 0.0 |

Table 4 shows, for example, that the system depicted in FIG. 11 is effective to condense a substantial portion of the C3-C5 hydrocarbons to produce the r-LPyG, while a substantial portion of the ethane and lighter components exit the process as vapor (e.g., the non-condensable/dry gas).

Definitions

It should be understood that the following is not intended to be an exclusive list of defined terms. Other definitions may be provided in the foregoing description, such as, for example, when accompanying the use of a defined term in context.

As used herein, the terms "a," "an," and "the" mean one or more.

As used herein, the term "and/or," when used in a list of two or more items, means that any one of the listed items can be employed by itself or any combination of two or more of the listed items can be employed. For example, if a composition is described as containing components A, B, and/or C, the composition can contain A alone; B alone; C alone; A and B in combination; A and C in combination, B and C in combination; or A, B, and C in combination.

As used herein, the phrase "at least a portion" includes at least a portion and up to and including the entire amount or time period.

As used herein, the term "chemical pathway" refers to the chemical processing step or steps (e.g., chemical reactions, physical separations, etc.) between an input material and a product material, where the input material is used to make the product material.

As used herein, the term "chemical recycling" refers to a waste plastic recycling process that includes a step of chemically converting waste plastic polymers into lower molecular weight polymers, oligomers, monomers, and/or non-polymeric molecules (e.g., hydrogen, carbon monoxide, methane, ethane, propane, ethylene, and propylene) that are useful by themselves and/or are useful as feedstocks to another chemical production process(es).

As used herein, the term "co-located" refers to the characteristic of at least two objects being situated on a common physical site, and/or within one mile of each other.

As used herein, the term "commercial scale facility" refers to a facility having an average annual feed rate of at least 500 pounds per hour, averaged over one year.

As used herein, the terms "comprising," "comprises," and "comprise" are open-ended transition terms used to transition from a subject recited before the term to one or more elements recited after the term, where the element or elements listed after the transition term are not necessarily the only elements that make up the subject.

As used herein, the term "cracking" refers to breaking down complex organic molecules into simpler molecules by the breaking of carbon-carbon bonds.

As used herein, the terms "credit-based recycled content," "non-physical recycled content," and "indirect recycled content" all refer to matter that is not physically traceable back to a waste material, but to which a recycled content credit has been attributed.

As used herein, the term "directly derived" refers to having at least one physical component originating from waste material.

As used herein, the terms "including," "include," and "included" have the same open-ended meaning as "comprising," "comprises," and "comprise" provided above.

As used herein, the term "indirectly derived" refers to having an applied recycled content (i) that is attributable to waste material, but (ii) that is not based on having a physical component originating from waste material.

As used herein, the term "located remotely" refers to a distance of at least 0.1, 0.5, 1, 5, 10, 50, 100, 500, or 1000 miles between two facilities, sites, or reactors.

As used herein, the term "mass balance" refers to a method of tracking recycled content based on the mass of the recycled content in various materials.

As used herein, the terms "physical recycled content" and "direct recycled content" both refer to matter that is physically traceable back to a waste material.

As used herein, the term "predominantly" means more than 50 percent by weight. For example, a predominantly propane stream, composition, feedstock, or product is a stream, composition, feedstock, or product that contains more than 50 weight percent propane.

As used herein, the term "pyrolysis" refers to thermal decomposition of one or more organic materials at elevated temperatures in an inert (i.e., substantially oxygen free) atmosphere.

As used herein, the terms "pyrolysis gas" and "pygas" refer to a composition obtained from pyrolysis that is gaseous at 25° C.

As used herein, the terms "pyrolysis oil" or "pyoil" refers to a composition obtained from pyrolysis that is liquid at 25° C. and 1 atm.

As used herein, the term "pyrolysis residue" refers to a composition obtained from pyrolysis that is not pyrolysis gas or pyrolysis oil and that comprises predominantly pyrolysis char and pyrolysis heavy waxes.

As used herein, the term "recycled content" refers to being or comprising a composition that is directly and/or indirectly derived from recycled material. Recycled content is used generically to refer to both physical recycled content and credit-based recycled content. Recycled content is also used as an adjective to describe material having physical recycled content and/or credit-based recycled content.

As used herein, the term "recycled content credit" refers to a non-physical measure of physical recycled content that can be directly or indirectly (i.e., via a digital inventory) attributed from a first material having physical recycled content to a second material having less than 100 percent physical recycled content.

As used herein, the term "total recycled content" refers to the cumulative amount of physical recycled content and credit-based recycled content from all sources.

As used herein, the term "waste material" refers to used, scrap, and/or discarded material.

As used herein, the terms "waste plastic" and "plastic waste" refer to used, scrap, and/or discarded plastic materials.

Additional Claim Supporting Description—First Embodiment

In a first embodiment of the present technology there is provided a process for producing one or more recycled content product streams from a cracker facility, the process comprising: (a) pyrolyzing waste plastic to thereby produce a recycled content pyrolysis gas (r-pygas); (b) liquifying at least a portion of the r-pygas to thereby provide a recycled content liquified pyrolysis gas (r-LPyG); (c) cracking a hydrocarbon feed stream in a cracking furnace of a cracker facility to thereby produce an cracked furnace effluent stream; (d) combining at least a portion of the r-LPyG with the cracked effluent stream to thereby produce a combined recycled content stream; and (e) separating the combined recycled content stream in a separation zone of the cracker facility to provide at least one recycled content hydrocarbon product stream.

The first embodiment described in the preceding paragraph can also include one or more of the additional aspects/features listed in the following bullet pointed paragraphs. Each of the below additional features of the first embodiment can be standalone features or can be combined with one or more of the other additional features to the extent consistent. Additionally, the following bullet pointed paragraphs can be viewed as dependent claim features having levels of dependency indicated by the degree of indention in the bulleted list (i.e., a feature indented further than the feature(s) listed above it is considered dependent on the feature(s) listed above it).

- further comprising quenching the cracked effluent in a quench zone to form a quenched effluent; compressing the quenched effluent in a compression zone to form a compressed effluent; and introducing the compressed effluent into the separation zone, wherein the combining of step (d) occurs at one or more of the following locations: (i) downstream of the quench zone and upstream of the compression zone; (ii) in the compression zone; (iii) downstream of the compression zone and upstream of the separation zone; and (iv) in the separation zone.
- wherein the temperature of the r-LPyG combined with the cracked effluent stream is within 5, 10, 15, 20, 25, or 50° C. of the temperature of the cracked effluent stream during the combining of step (d).
- wherein the pressure of the r-LPyG combined with the cracked effluent stream is within 10, 25, 50, 75, 100 psig of the temperature of the cracked effluent stream during the combining of step (d).
- wherein the hydrocarbon feed stream to the cracker comprises at least 50, 75, 90, or 95 weight percent C5 to C22 components.
- wherein the hydrocarbon feed stream to the cracker comprises at least 50, 75, 90, or 95 weight percent of C2 to C5 components.
- wherein the combined recycled content stream includes r-LPyG in an amount of 5 to 95 percent, 10 to 80 percent, or 15 to 75 percent.
- wherein the recycled content hydrocarbon product stream comprises at least one of a recycled content ethylene stream, a recycled content propylene stream, a recycled content ethane stream, a recycled content propane stream, a recycled content butane stream, and a recycled content C5+ streams.
  - further comprising combining at least a portion of a recycled content ethane stream, a recycled content propane stream, and/or a recycled content butane stream with the hydrocarbon feed stream to the cracker upstream of the furnace outlet.
- wherein the pyrolyzing converts 0.5 to 50, 1 to 40, 2 to 30, or 4 to 25 weight percent of the waste plastic to the r-pygas.
- wherein the pyrolyzing is carried out at a peak pyrolysis temperature of 325 to 800° C., 350 to 600° C., 375 to 500° C., 390 to 450° C., or 400 to 500° C.
  - wherein the pyrolyzing is carried out at a pressure of 0.1 to 60 barg, 0.2 to 10 barg, or 0.3 to 1.5 barg and a residence time of 1 second to 1 hour, 10 seconds to 30 minutes, or 30 seconds to 10 minutes.
- wherein the liquifying of step (b) includes subjecting the r-pygas to 1 to 15, 2 to 10, or 3 to 6 compression steps, wherein each compression step is followed by a cooling step, wherein each cooling step is followed by a vapor/liquid separation step, and wherein the r-LPyG comprises a combination of separated liquids recovered from at least 2, 3, 4, or all of the vapor/liquid separation steps.
- wherein the r-pygas comprises at least 50, 75, 90, or 95 weight percent of C1-C5 compounds, at least 50, 60, 70, 80, 90 or 95 weight percent of C3-C5 compounds, less than 80, 50, 40, or 25 weight percent of C1-C2 compounds, and less than 50, 25, 10, or 5 weight percent of C6+ compounds.
- wherein the r-LPyG comprises at least 50, 75, 90, or 95 weight percent of C1-C5 compounds, at least 25, 50, 75, or 80 weight percent of C2-C4 compounds, less than 60, 40, 20, or 15 weight percent of C1-C2 compounds, and less than 50, 25, 10, or 5 weight percent of C6+ compounds.
- wherein the premium r-LPyG comprises at least 95, 97, 98, or 99 weight percent of C1-C5 compounds, at least 90, 95, 97, 98, or 99 weight percent of C2-C4 compounds, less than 40, 30, 20, 10, or 5 weight percent of C1 and C2 compounds, and less than 25, 10, 5, 2, or 1 weight percent of C6+ compound.
- wherein the premium r-LPyG exhibits at least one, two, three, four, five, six, seven, eight, nine, ten, eleven, twelve, thirteen, fourteen, fifteen, or all sixteen of the following characteristics:
  - i.) the premium r-LPyG comprises at least 97 weight percent of C3-C5 compounds, ii.) the premium r-LPyG comprises less than 200 ppm by weight of ethane and lighter components, iii.) the premium r-LPyG comprises less than 20 ppm by weight of ethylene, iv.) the premium r-LPyG comprises less than 1 weight percent of C6+ compounds, v.) the premium r-LPyG comprises less than 1 ppmw of CO, vi.) the premium r-LPyG comprises less than 1 ppmw of CO2, vii.) the premium r-LPyG has a dew point of less than −50° F., viii.) the premium r-LPyG comprises less than 1 ppbw of arsine, ix.) the premium r-LPyG comprises less than 1 ppmw of total nitrogen, x.) the premium r-LPyG comprises less than 1 ppmw of nitrogen as N2, xi.) the premium r-LPyG comprises less than 10 ppmw of methyl acetate, xii.) the premium r-LPyG comprises less than 10 ppmw of propadiene, xiii.) the premium r-LPyG comprises less than 5 ppmw of methanol, xiv.) the premium r-LPyG comprises less than 15 ppbw of total sulfur, xv.) the premium r-LPyG comprises less than 1 ppmw of total chlorine, xvi.) the premium r-LPyG comprises less than 10 ppmw of total organic oxygenates, and/or xvii.) the premium r-LPyG comprises less than 0.5 ppmw of oxygen as 02.

wherein the r-LPyG exhibits at least one, two, three, four, five, six, seven, eight, nine, ten, eleven, twelve, thirteen, fourteen, fifteen, or all sixteen of the following characteristics:

i.) the r-LPyG comprises at least 97 weight percent of C3-C5 compounds, ii.) the r-LPyG comprises less than 2 liquid volume percent of ethane and lighter components, iii.) the r-LPyG comprises less than 1 weight percent of C6+ compounds, iv.) the r-LPyG comprises less than 1 ppmw of CO, v.) the r-LPyG comprises less than 5 weight percent of CO2, vi.) the r-LPyG as comprises less than 0.1 weight percent of H2O, vii.) the r-LPyG comprises less than 200 ppbw of arsine, viii.) the r-LPyG comprises less than 10 ppmw of total nitrogen, ix.) the r-LPyG comprises less than 15 ppmw of nitrogen as N2, x.) the r-LPyG comprises less than 10 ppmw of methyl acetate, xi.) the r-LPyG comprises less than 10 ppmw of propadiene, xii.) the r-LPyG comprises less than 5 ppmw of methanol, xiii.) the r-LPyG comprises less than 15 ppbw of total sulfur, xiv.) the r-LPyG comprises less than 5 ppmw of total chlorine, XV.) the r-LPyG comprises less than 5 weight percent of total organic oxygenates, and/or xvi.) the r-LPyG comprises less than 5 ppmw of oxygen as 02.

wherein the pyrolysis facility and the cracking facility are co-located.

wherein the pyrolysis facility and the cracking facility are located on different sites and the r-pygas further comprising, subsequent to the liquifying, purifying the at least a portion of the r-LPyG to produce a premium r-LPyG and wherein the combining of step (d) includes combining at least a portion of the premium r-LPyG with the cracked effluent stream.

wherein the purifying includes a step of removing one or more of the following components: carbon monoxide, carbon dioxide, hydrogen sulfide, arsine, nitrogen, methyl acetate, propadiene, methanol, chlorine, oxygen, and organic oxygenates.

wherein the purifying comprises at least one of the following steps (i) through (iv):

i.) removing one or more compounds from the r-LPyG via absorption and/or stripping;

ii.) removing moisture from the r-LPyG;

iii.) removing at least 90 (92, 95, 97, 99) percent of the C2 and lighter components from the r-LPyG via distillation; and iv.) removing at least 90 (92, 95, 97, 99) percent of the C6 and heavier components from the r-LPyG via distillation.

Additional Claim Supporting Description—Second Embodiment

In a second embodiment of the present technology there is provided a process for producing one or more recycled content product streams from a cracker facility, the process comprising: (a) cracking a hydrocarbon feed stream in a cracking furnace of a cracker facility to thereby produce a cracked effluent stream; (b) quenching at least a portion of the cracked effluent stream in a quench zone to thereby produce a quenched effluent stream; (c) compressing at least a portion of the quenched effluent stream in a compression zone to thereby produce a compressed effluent stream; (d) separating the compressed effluent stream in a separation zone to thereby produce one or more hydrocarbon products; and (e) introducing a stream of recycled content liquified pyrolysis gas (r-LPyG) formed from the pyrolysis of waste plastic into one or more of the following locations (i) through (iv): (i) downstream of the quench zone and upstream of the compression zone; (ii) in the compression zone; (iii) downstream of the compression zone and upstream of the separation zone; and (iv) in the separation zone, wherein at least one of said hydrocarbon products comprises at least a portion of said r-LPyG and is a recycled content hydrocarbon product.

The second embodiment described in the preceding paragraph can also include one or more of the additional aspects/features listed in the following bullet pointed paragraphs. Each of the below additional features of the second embodiment can be standalone features or can be combined with one or more of the other additional features to the extent consistent. Additionally, the following bullet pointed paragraphs can be viewed as dependent claim features having levels of dependency indicated by the degree of indention in the bulleted list (i.e., a feature indented further than the feature(s) listed above it is considered dependent on the feature(s) listed above it).

wherein the r-LPyG is combined with the effluent stream in one or more of locations (i) through (iv).

introducing a stream of recycled content liquified pyrolysis gas (r-LPyG) formed from the pyrolysis of waste plastic into two of locations (i) through (iv).

wherein the introducing includes introducing the r-LPyG into the inlet of a compression stage.

wherein the introducing includes introducing the r-LPyG into the inlet of a distillation column or a vapor-liquid separator.

further comprising, pyrolyzing waste plastic in a pyrolysis facility to thereby produce a recycled content pyrolysis gas (r-pygas), liquifying at least a portion of the r-pygas to thereby produce the recycled content liquified pyrolysis gas (r-LPyG).

further comprising, purifying at least a portion of the r-LPyG to produce a premium r-LPyG and introducing at least a portion of the premium r-LPyG into one or more of locations (i) through (iv).

Additional Claim Supporting Description—Third Embodiment

In a third embodiment of the present technology there is provided a process for producing one or more recycled content product streams from a cracker facility, the process comprising: a process for producing one or more recycled content product streams from a cracker facility, the process comprising introducing a stream of recycle content liquified pyrolysis gas (r-LPyG) formed from the pyrolysis of waste plastic into the cracker facility at a location downstream of a furnace in the cracker facility.

The third embodiment described in the preceding paragraph can also include one or more of the additional aspects/features listed in the following bullet pointed paragraphs. Each of the below additional features of the second embodiment can be standalone features or can be combined with one or more of the other additional features to the extent consistent. Additionally, the following bullet pointed paragraphs can be viewed as dependent claim features having levels of dependency indicated by the degree of indention in the bulleted list (i.e., a feature indented further than the feature(s) listed above it is considered dependent on the feature(s) listed above it).

wherein the location downstream of the furnace is located upstream of the compression zone.

wherein the location downstream of the furnace is downstream of the compression zone.

wherein the location downstream of the furnace is at the inlet to a compression stage.

wherein the location downstream of the furnace is at the inlet of a distillation column.

wherein the r-LPyG comprises at least 75 weight percent of C1-C5 compounds, at least 50 weight percent of C3-C5 compounds, less than 40 weight percent of C1-C2 compounds, and less than 25 weight percent of C6+ compounds.

wherein the r-LPyG is premium r-LPyG and comprises at least 95 weight percent C3 to C5 compounds, less than 200 ppm by weight of C2 and lighter compounds, and less than 1 weight percent of C1 and lighter compounds.

CLAIMS NOT LIMITED TO DISCLOSED EMBODIMENTS

The preferred forms of the invention described above are to be used as illustration only and should not be used in a limiting sense to interpret the scope of the present invention. Modifications to the exemplary embodiments, set forth above, could be readily made by those skilled in the art without departing from the spirit of the present invention.

The inventors hereby state their intent to rely on the Doctrine of Equivalents to determine and assess the reasonably fair scope of the present invention as it pertains to any apparatus not materially departing from but outside the literal scope of the invention as set forth in the following claims.

What is claimed is:

1. A process for producing one or more recycled content product streams from a cracker facility, the process comprising:

a) pyrolyzing waste plastic to thereby produce a recycled content pyrolysis gas (r-pygas);

b) liquifying at least a portion of the r-pygas to thereby provide a recycled content liquified pyrolysis gas (r-LPyG);

c) cracking a hydrocarbon feed stream in a cracking furnace of a cracker facility to thereby produce a cracked furnace effluent stream;

d) combining at least a portion of the r-LPyG with the cracked effluent stream to thereby produce a combined recycled content stream; and e) separating the combined recycled content stream in a separation zone of the cracker facility to provide at least one recycled content hydrocarbon product stream.

2. The process of claim 1, further comprising quenching the cracked effluent in a quench zone to form a quenched effluent; compressing the quenched effluent in a compression zone to form a compressed effluent; and introducing the compressed effluent into the separation zone, wherein the combining of step (d) occurs at one or more of the following locations: (i) downstream of the quench zone and upstream of the compression zone; (ii) in the compression zone; (iii) downstream of the compression zone and upstream of the separation zone; and (iv) in the separation zone.

3. The process of claim 1, wherein the temperature of the r-LPyG combined with the cracked effluent stream is within 50° C. of the temperature of the cracked effluent stream during the combining of step (d).

4. The process of claim 1, wherein the pressure of the r-LPyG combined with the cracked effluent stream is within 100 psig of the pressure of the cracked effluent stream during the combining of step (d).

5. The process of claim 1, wherein the hydrocarbon feed stream to the cracker comprises at least 50 weight percent C5 to C22 components.

6. The process of claim 1, wherein the hydrocarbon feed stream to the cracker comprises at least 50 weight percent of C2 and/or C3 alkanes.

7. The process of claim 1, wherein the at least one recycled content hydrocarbon product stream comprises at least one of a recycled content ethylene stream, a recycled content propylene stream, a recycled content ethane stream, a recycled content propane stream, a recycled content butane stream, or a recycled content C5+ streams.

8. The process of claim 1, wherein the liquifying of step (b) includes subjecting the r-pygas to 2 to 10 compression steps, wherein each compression step is followed by a cooling step, wherein each cooling step is followed by a vapor/liquid separation step, and wherein the r-LPyG comprises a combination of separated liquids recovered from at least 2, 3, 4, or all of the vapor/liquid separation steps.

9. The process of claim 1, wherein the r-pygas comprises at least 50 weight percent of C1-C5 compounds, at least 50 weight percent of C3-C5 compounds, less than 80 weight percent of C1-C2 compounds, and less than 25 weight percent of C6+ compounds and the r-LPyG comprises at least 75 weight percent of C1-C5 compounds, at least 50 weight percent of C2-C4 compounds, less than 40 weight percent of C1-C2 compounds, and less than 25 weight percent of C6+ compounds.

10. The process of claim 1, wherein the pyrolysis facility and the cracking facility are co-located.

11. The process of claim 1, wherein said combining occurs at a location downstream of a compression zone and upstream of at least a portion of the separation zone at a distillation column inlet.

12. The process of claim 1, wherein the combining occurs at an inlet of a demethanizer column.

13. The process of claim 1, wherein the combining occurs at an inlet of the first a compression stage.

14. A process for producing one or more recycled content product streams from a cracker facility, the process comprising:

a) cracking a hydrocarbon feed stream in a cracking furnace of a cracker facility to thereby produce a cracked effluent stream;

b) quenching at least a portion of the cracked effluent stream in a quench zone to thereby produce a quenched effluent stream;

c) compressing at least a portion of the quenched effluent stream in a compression zone to thereby produce a compressed effluent stream;

d) separating the compressed effluent stream in a separation zone to thereby produce one or more hydrocarbon products; and e) pyrolyzing waste plastic in a pyrolysis facility to thereby produce a recycled content pyrolysis gas (r-pygas), liquifying at least a portion of the r-pygas to thereby produce a recycled content liquified pyrolysis gas (r-LPyG), and introducing a stream of the recycled content liquified pyrolysis gas (r-LPyG) into one or more of the following locations (i) through (iv):

i.) downstream of the quench zone and upstream of the compression zone;

ii.) in the compression zone;

iii.) downstream of the compression zone and upstream of the separation zone; and iv.) in the separation zone, wherein at least one of said hydrocarbon products comprises at least a portion of said r-LPyG and is a recycled content hydrocarbon product.

15. The process of claim 14, wherein the introducing of step (d) includes introducing the r-LPyG into an inlet of a distillation column or a vapor-liquid separator.

16. A process for producing one or more recycled content product streams from a cracker facility, the process comprising pyrolyzing waste plastic in a pyrolysis facility to thereby produce a recycled content pyrolysis gas (r-pygas), liquifying at least a portion of the r-pygas to thereby produce a recycled content liquified pyrolysis gas (r-LPyG), and introducing a stream of the recycle content liquified pyrolysis gas (r-LPyG) into the cracker facility at a location downstream of a furnace in the cracker facility, wherein the cracker facility produces one or more hydrocarbon products comprising at least a portion of said r-LPyG.

17. The process of claim 16, wherein the location downstream of the furnace is downstream of a compression zone.

18. The process of claim 16, wherein the location downstream of the furnace is at an inlet of a distillation column.

19. The process of claim 16, wherein the r-LPyG is premium r-LPyG and comprises at least 95 weight percent C3 to C5 compounds and less than 200 ppm by weight of C2 and lighter compounds.

* * * * *